US010578135B2

(12) United States Patent
Fuhrmann

(10) Patent No.: US 10,578,135 B2
(45) Date of Patent: Mar. 3, 2020

(54) OPERATING CYLINDER DEVICE WITH AT LEAST ONE OPERATING CYLINDER UNIT WITH MECHANICAL POSITION SAFETY AND OPERATING METHOD

(71) Applicant: Henning Fuhrmann, Gelsenkirchen (DE)

(72) Inventor: Henning Fuhrmann, Gelsenkirchen (DE)

( * ) Notice: Subject to any disclaimer, the term of this patent is extended or adjusted under 35 U.S.C. 154(b) by 197 days.

(21) Appl. No.: 15/855,566

(22) Filed: Dec. 27, 2017

(65) Prior Publication Data

US 2018/0180071 A1 Jun. 28, 2018

(30) Foreign Application Priority Data

Dec. 28, 2016 (DE) ..... 10 2016 125 782
Oct. 9, 2017 (DE) ..... 20 2017 106 100 U

(51) Int. Cl.

| | |
|---|---|
| ***F15B 15/26*** | (2006.01) |
| ***F15B 15/16*** | (2006.01) |
| ***F15B 15/28*** | (2006.01) |
| ***B66F 3/30*** | (2006.01) |
| ***B66F 3/28*** | (2006.01) |

(52) U.S. Cl.

CPC ..... *F15B 15/261* (2013.01); *B66F 3/28* (2013.01); *B66F 3/30* (2013.01); *F15B 15/16* (2013.01); *F15B 15/2846* (2013.01); *F15B 15/2892* (2013.01); *F15B 2211/40576* (2013.01); *F15B 2211/6306* (2013.01); *F15B 2211/6336* (2013.01); *F15B 2211/6653* (2013.01); *F15B 2211/72* (2013.01)

(58) Field of Classification Search

CPC ..... F15B 15/16; F15B 15/165; F15B 15/261; F15B 15/268; F15B 15/2846

See application file for complete search history.

(56) References Cited

U.S. PATENT DOCUMENTS

| | | | | |
|---|---|---|---|---|
| 3,831,901 A * | 8/1974 | Williams | ..... | F15B 15/16 92/15 |
| 4,471,944 A * | 9/1984 | Leray | ..... | F15B 15/16 92/29 |
| 4,525,999 A * | 7/1985 | Inman | ..... | F15B 15/19 92/52 |

(Continued)

FOREIGN PATENT DOCUMENTS

| | | |
|---|---|---|
| DE | 7130374 | 8/1971 |
| DE | 3708989 | 10/1988 |
| DE | 3744084 | 7/1989 |

(Continued)

*Primary Examiner* — Michael Leslie

(74) *Attorney, Agent, or Firm* — Head, Johnson, Kachigian & Wilkinson, PC

(57) ABSTRACT

In order to secure a reached extension position of a piston rod (22, 22') of an in particular multi stage operating cylinder device (100) with at least one operating cylinder unit (50) not only through the operating pressure in the cylinder (1, 1') of the operating cylinder unit (50) but additionally mechanically, a mechanical safety through interlocking safety elements (4*a, b*) in the interior of the operating cylinder device (100) is provided which is activated exclusively by the operating pressure in the first pressure cavity and disengaged by a pressure in a second operating cavity.

25 Claims, 10 Drawing Sheets

(56) References Cited

U.S. PATENT DOCUMENTS

| | | | | |
|---|---|---|---|---|
| 5,341,724 | A * | 8/1994 | Vatel | F15B 15/16 91/1 |
| 9,440,826 | B2 | 9/2016 | Prisk | |

FOREIGN PATENT DOCUMENTS

| | | |
|---|---|---|
| DE | 19800296 | 7/1999 |
| DE | 19960376 | 6/2001 |
| DE | 102004049854 | 4/2006 |
| DE | 102012101865 | 9/2013 |
| DE | 202016006610 | 1/2017 |
| GB | 1432041 | 4/1976 |

* cited by examiner

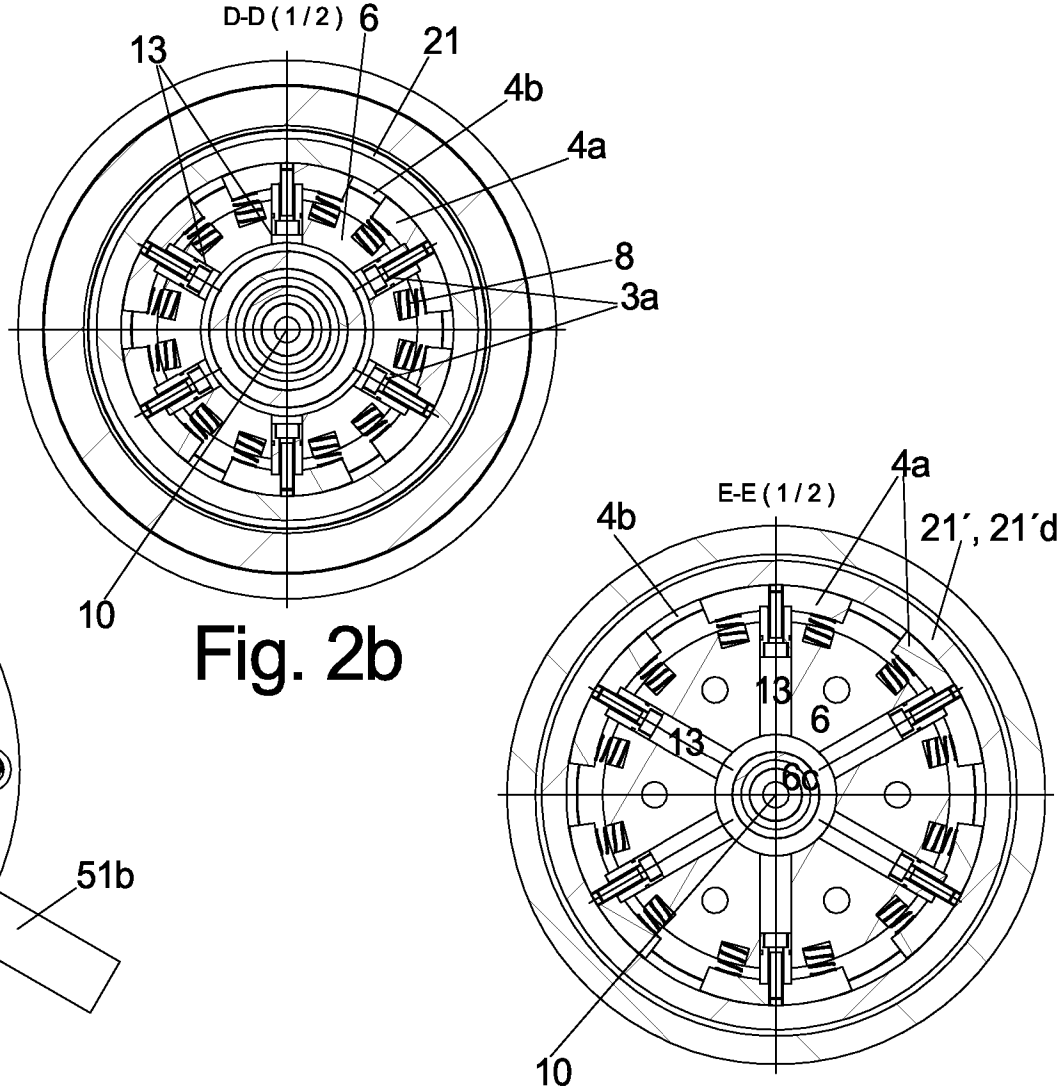
Fig. 2b
Fig. 2c
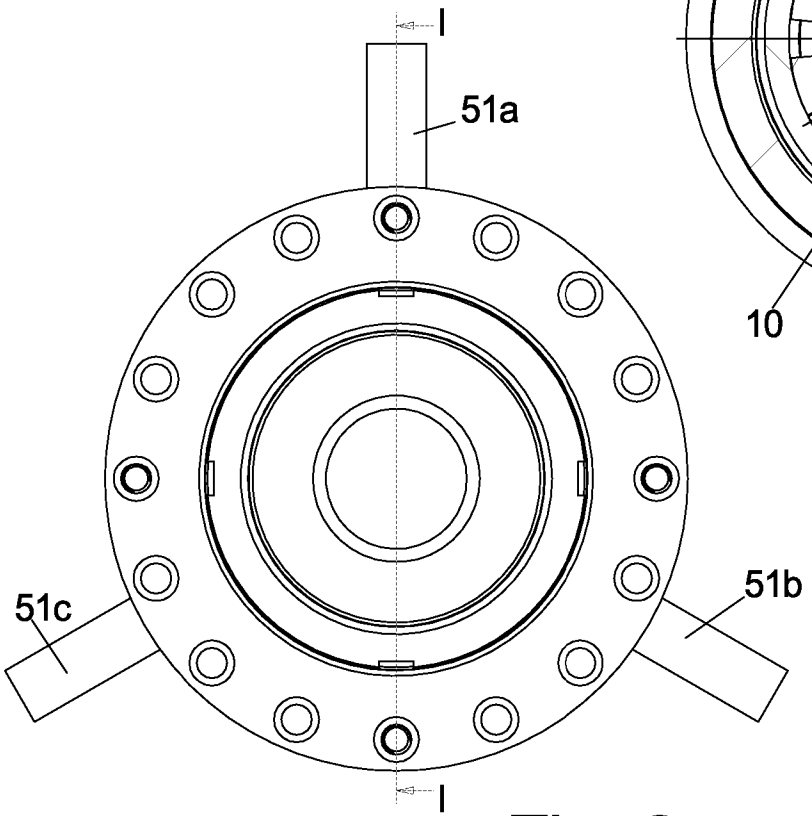
Fig. 2a

OPERATING CYLINDER DEVICE WITH AT LEAST ONE OPERATING CYLINDER UNIT WITH MECHANICAL POSITION SAFETY AND OPERATING METHOD

I. FIELD OF THE INVENTION

The invention relates to an operating cylinder device including at least one operating cylinder unit also designated piston cylinder unit which includes a cylinder with essentially closed cylinder base and a piston supported therein sealed axially tight. Between the cylinder base and the piston a first pressure cavity is provided which is loadable with an operating medium that is under pressure and which is fed through a pressure cavity connection which is typically arranged in the cylinder base.

The operating cylinder units are being used with different operating media, e.g. as hydraulic cylinder and pneumatic cylinder to perform linear movements. The connecting rod protrudes from the cylinder also in a completely retracted position of the piston and is connectable with its free end with a part that is to be moved e.g. a load that is to be lifted. There are two different embodiments:

Piston with piston rod:

On a side of the piston that is oriented away from the cylinder base a connecting rod that is fixed at the piston extends axially partially out of the cylinder wherein the connecting rod has a smaller cross section than the piston. The piston now has a rather short piston sealing surface compared to an axial length of the cylinder interior wherein the piston sealing surface is within the cylinder in all extension positons of the piston. This short piston sealing surface moves in a sealing manner axially relative to the cylinder sealing surface which extends essentially over an entire length of the cylinder interior wherein the cylinder sealing surface has to be provided as a smooth sealing surface.

The free end of the cylinder typically additionally includes an annular wiper that contacts an outer circumference of the connecting rod in order to prevent a penetration of foreign objects between the outer circumference of the connecting rod and the cylinder inner surface.

When the wiper forms an additional sealing surface a second pressure cavity is formed between the additional sealing surface and the piston in the cylinder wherein the second pressure cavity can be loaded separately from the first pressure cavity with a pressurized operating medium so that an operating cylinder unit is provided that is move able in a controlled manner in both ways thus in both axial directions.

Piston=connecting rod, plunger:

The cylinder only has a so called rod sealing surface that is relatively short compared to an axial length of the cylinder interior wherein the rod sealing surface is provided at an open forward end of the cylinder in a form of an interior inner circumferential surface whereas the cylinder has a larger inner diameter over the remaining length.

The connecting rod itself functions as a piston wherein the connecting rod has a smooth piston sealing surface configured as an exterior circumferential surface that has about the same length as the axial length of the cylinder interior space, wherein the short rod sealing surface of the cylinder always contacts the outer circumferential surface in a sealing manner whereas the cylinder circumferential surface of the cylinder maintains a radial distance from the concentric piston sealing surface over the remaining length. Optionally the free inner end of the connecting rod which acts as a displacement element thus plunger when inserted into the cylinder has to be supported in the cylinder cross section by additional measures.

Based on configuration this embodiment only has a first pressure cavity so that an operating cylinder of this type is only loadable with operating medium on one side which causes the piston rod to move in an axially outward direction.

The instant application relates to this second embodiment which operates according to the displacement principle and which is designated as plunger type.

II. TECHNICAL BACKGROUND

Depending on the application it can be required that in particular for safety reasons a reached extension position of the piston rod relative to the cylinder is not only provided by providing the necessary pressure in the pressure cavity of the cylinder but additionally a mechanical, friction locked or form locked safety of the axial position of the connecting rod is provided, if possible at any extension position thus continuously variable or at least in individual increments with minimum distance from one increment to another.

When the operating cylinder unit is configured telescopable in several stages in mechanical position safety of this type is certainly provided at each telescope stage.

This is important in particular when the operating cylinder unit is used for lifting an object and subsequently supporting it in a lifted condition, possibly for a longer time period during which it shall be possible to switch off the pressure boosting system.

A typical application for this type of typically multi stage operating cylinder unit as a lifting device which then typically has 3 three circumferentially distributed support legs and which is therefore called a tri pod for horizontally lifting an aircraft, for example when heavy maintenance has to be performed or the landing gear has to be tested or repaired in unloaded condition.

Then different locations of the aircraft are provided with at least three operating cylinder units combined as operating cylinder devices for lifting and typically a fourth unit for support and position safety, a respective operating cylinder unit is typically installed in a so called tripod, thus to prevent tipping and including a support frame with 3 radially extending support struts. These operating cylinder units are typically also in other applications not only telescope able in one stage but often also telescope able in two or more stages when a low height of the support points for the tripods at the parked unloaded aircraft and the required maximum lifting height of the tripod.

Since wings of an aircraft are very sensitive to point loads and thus the aircraft is a very sensitive object to lift it has to be assured that vertical lifting is performed at all support points simultaneously and uniformly within very small geometric tolerances and in any case the rapid and quick loss of support at one of the support points has to be prevented since this can easily cost expensive damages to the aircraft.

In known solutions each operating cylinder unit includes a self-hemming safety thread on an outer circumference of the piston rod on which a safety nut that meshes with the safety thread can be moved axially by threading, which however has numerous disadvantages.

Typically the aircraft is then lifted up in that the piston rods are extended hydraulically from the cylinder units of each tripod very slowly and if possible synchronously after the piston rods contact the respective support point of the aircraft thus in this case the piston rods are extended in upward direction and thus at each of the support rods, e.g. the tripods an operator is placed with the only task to move the safety nut manually and continuously along the upward extending thread in a downward direction and to keep the safety nut continuously at a very small distance from a radially extending support surface arranged under the safety nut.

Additionally also an operator cannot easily walk from one tripod to another, thus from one lifting device to another and operate several of them simultaneously since the tripods are several meters tall and the safety nut is significantly above gripping height so that the operator has to stand on a platform or ladder of the tripod which he must not leave for safety reasons.

This way lifting and jacking a commercial aircraft typically takes more than an hour requiring a team of up to seven men only for manually synchronously moving the safety nuts and communicating, monitoring and providing back up and service.

Furthermore the fact that the safety thread is on an outside of the piston rod has its own disadvantages.

The outer surfaces of the thread turns on the piston rod have to contact the portion of the inner circumferential surface of the cylinder that is configured as the cylinder sealing surface in order to provide axial and lateral support of the piston rod. This way however the inner circumferential surface of the cylinder is subject to much stronger wear from the thread turns sliding along compared to a continuously smooth outer circumferential surface of a piston rod sliding along.

Omitting a friction support of the piston rod with the exterior thread relative to a portion of the inner circumferential surface of the cylinder forming a cylinder seal surface is not permissible due to a lack of tipping safety since the support portion of the piston in axial direction does not suffice for a forced support.

Another disadvantage of this external thread is a complex and expensive configuration of the friction resistant corrosion protection of the other thread which is necessary since smooth actuation of the safety nut that is continuously manually readjusted has to be provided under all conditions.

Additionally measures have to be taken to prevent a rotation of the piston rod about its axial direction since this in turn would cause a rotation relative to the contact point at the aircraft and would otherwise cause a binding of the safety nut relative to the support surface or offset of the safety nut from the support surface depending on the direction of rotation.

III. BRIEF SUMMARY OF THE INVENTION a) Technical Object

Thus it is an object of the invention to provide an operating cylinder device with at least operating cylinder unit with a mechanical safety for a current axial position of the piston rod and a method for operating an operating cylinder device which provides cost effective production and a high level of safety, in particular through an externals visible display of the operating condition, in particular of the interlocking and several piston cylinder units can be operated jointly and synchronously by a small number of required operators for jointly lifting an object.

Another object of the invention is to reduce a size of an operating crew by automating mechanical safety and synchronization of plural operating cylinder units that are being used simultaneously for lifting an object.

b) Solution

The object is achieved by the features of claims 1, 16, and 21. Advantageous embodiments can be derived from the dependent claims.

With respect to the operating cylinder device and in particular its operating cylinder unit it is well known that an operating cylinder unit of this type is configured according to the plunger principle so that a cylinder that is open at a front face end and essentially closed or at least closable at a rear end by a cylinder base includes a circumferential seal at a forward open end of the cylinder interior at an inner circumferential surface, the so called rod seal unit.

The piston rod that partially protrudes into the cylinder and that is axially movable is configured as a smooth piston seal surface at its outer circumferential surface at least over a substantial portion, at least however over the portion that is configured as a maximally deployable operating stroke through pressure increase in the closed cylinder, wherein the piston rod contacts the rod seal of the rod seal unit of the cylinder in a sealing manner with the smooth piston seal surface.

Thus, a first pressure cavity is provided which is defined by the cylinder and it cylinder base on the one hand side and by the piston rod that protrudes into the cylinder on the other hand side and which includes a first pressure cavity connection by which the first pressure cavity can be pressurized and where the piston rod can be pressed further out of the cylinder by displacing the piston rod by the pressure medium.

The mechanical position safety for a particular extension position that is known in principle but arranged outside of the cylinder, thus the axial position of the piston rod relative to the cylinder by cooperating, advantageously form locking safety elements includes according to the invention at least one piston side safety element that is attached in the axially rearward portion of the piston rod that is adjacent to the cylinder base and at the cylinder inner wall in axial direction respectively at least one cylinder side safety element arranged axially in series which can cooperate with the piston side safety element in that form locking safety elements can advantageously interlock with each other. Thus one safety element is provided as an interlocking recess in the cylinder interior wall and the other safety element, advantageously the piston side safety element is an e interlocking protrusion that is move able at least between an interlocked position and a non-interlocked position and the fits into the interlocking recess.

The cylinder side interlocking recesses are arranged in the inner circumferential surface of the cylinder, advantageously arranged in fixed position.

The interlocking recesses are thus advantageously arranged in axial direction at a constant axial distance from each other.

Advantageously the interlocking protrusion is movable in the radial direction, advantageously pivotable or radially displaceable. The piston side safety element, in particular the interlocking protrusion protrudes in outward direction beyond the outer contour of the piston seal surface in the interlocked position.

When the safety elements, in particular the interlocking protrusions and interlocking recesses are interlocked with each other advantageously in the radial direction the axial position of the piston rod relative to the piston is mechanically secured also when there is no pressure in the first pressure cavity.

Thus, measures have to be taken so that the interlocked position of the safety elements is also maintained without pressure in the first pressure cavity.

For this purpose the movable, in particular radially movable piston side interlocking protrusion is mostly arranged in the first pressure cavity and in particular the radial outer surface of the interlocking protrusion that is arranged in the first pressure cavity is greater than the radial inner surface of the interlocking protrusion that is arranged in the first pressure cavity. The remainder or at least a portion of the remaining rest of the radial inner surface that is not arranged in the first pressure cavity is advantageously loaded by a second pressure cavity and/or connected with another pressure and/or force generator which loads the interlocking protrusion in a radially outward direction. Thus, the first pressure cavity is sealed relative to the second pressure cavity at the interlocking protrusion, thus in particular about the interlocking protrusion so that no pressure balancing can be performed even over a long time period between the two pressure cavities through the gap between the interlocking protrusion and the component receiving the interlocking protrusion Advantageously a guide protrusion extends in a radially inward direction from the radial inner surface of each piston side interlocking protrusion and is supported in a guide recess circumferentially tight, e.g. by a seal like e.g. an O-ring that contacts an outer circumference of the support protrusion and an inner circumference of the surrounding support recess, in its movement direction in particular the radial direction so that the freely accessible radially inner face of the guide protrusion since it is connected with the first pressure cavity at least not directly can be connected on the one hand side with a pressure cavity and can be loaded in a radially outward direction and can be pressed in the radially outward direction by another force generator that is arranged in the guide recess, like e.g. a compression spring.

The question whether the interlocking protrusion moves radially outward into the interlocked position or radially inward into the non-interlocked position can thus be controlled by the relationship of the hydraulic forces applied to the interlocking protrusion in an radially inward and radially outward position which is possible from an interior of the piston rod.

At the same axial position the supplied interlocking recess can extend either in an annular manner over the entire circumference of the inner circumferential surface of the cylinder interior space as an interlocking ring groove or these can be plural interlocking protrusions that are distributed over the circumference and separated from each other.

Annular circumferential interlocking ring grooves can be produced in a rather simple manner. However this is associated with the disadvantage that the interlocking protrusion that are typically provided at the piston rod at plural locations of the circumference at identical axial positions penetrate the same annular interlocking groove but thus do not secure the piston rod against a rotation relative to the cylinder.

However, when the interlocking recesses are circumferentially defined interlocking recesses into which a respective interlocking protrusion fits which is sized so that it fits in the circumferential direction with little clearance a relative rotation of the piston rod and the cylinder is prevented, thus fabrication of the interlocking recesses is more complex.

The circumferentially defined interlocking recesses furthermore have the advantage that circumferential portions there between, in case these are continuous in axial direction, have an axially continuous smooth inner circumferential surface where the piston end piece can contact and can cause a centering of the piston end piece in the cylinder without risking abrasion.

Interlocking recesses that do not continue over the circumference can also be used for a reduced step height of the mechanical safety.

Since the mechanical safety has to sustain substantial loads in the axial direction the interlocking protrusion and thus also the interlocking recesses have a minimum extension in the axial direction that is a function of load bearing capability wherein the minimum extension predetermines an axial distance between the individual interlocking recesses in the inner circumferential surface of the cylinder.

However, when a smaller step height shall be implemented it can be provided for example that interlocking recesses with the necessary axial minimum distance are produced for example at two opposite first circumferential locations and over a segment angle of respectively less than 90° at second circumferential locations that are arranged opposite to one another and rotated relative thereto in the axial direction by 90° in turn over a segment angle of 90° at the most, however the interlocking recesses in the inner circumferential surface of the cylinder are fabricated at an intermediary level thus typically in a center of an axial distance of the pairs of interlocking recesses are the first circumferential location.

Thus the interlocking protrusions are configured as interlocking segments that extend over a portion of the circumference and in particular their faces oriented in the circumferential direction can also extend at as segment angle viewed in the axial direction.

The faces oriented in the circumferential direction are advantageously, in particular in their radial outer end portion arranged at a slant angle to the radial direction and inclined in a radial outward direction towards a center of the interlocking protrusion viewed in an axial top view and also the face flanks of the interlocking protrusions cause a centering relative to each other in the circumferential direction when the interlocking segments engage the interlocking recesses that are defined in the circumferential direction.

When a total of four interlocking protrusion thus interlocking segments are provided in the piston rod at analog circumferential positions which are loadable with a radially outward oriented force in pairs and separate from their inner surfaces that are opposite to each other a step height of the mechanical safety is achieved that is cut in half over the maximum minimum distance of the interlocking protrusions.

It is appreciated that interlocking recesses can be arranged at the same axial position at 3 or more circumferential locations instead of two circumferential locations and also a more than 2-step subdivision of the minimum distance instead of a 2-step subdivision of the interlocking recesses that are arranged at the same circumferential position can be provided.

Advantageously the piston rod is configured at least in two pieces in that it is configured as a smooth piston seal surface besides the shaft whose outer circumferential surface is configured as a smooth piston seal surface over a substantial portion of its length which represents the stroke of its piston rod through the face sealed cylinder opening wherein a piston end piece is attached tight at a rear free end of the shaft.

The interlocking protrusions can then be attached at a rear free end of the piston end piece of the plunger or displacer piston rod which simplifies production of the piston rod.

Advantageously the interlocking segments are not only supported by the support protrusions at least on the axial forward and rear side surface relative to the piston rod, in particular the piston end piece in a receiver recess which is advantageously configured as a receiving ring groove that extends circumferentially over the outer circumference and which are advantageously additionally secured in a form locking manner against a displacement in the circumferential direction.

This can be accomplished for example in that a support protrusion extends in a radially inward direction from a radial back side of each interlocking protrusion, in particular each interlocking segment and wherein the support protrusion is radially supported in a support recess which can be additionally provided separately from the support recess that is loadable from a second inner pressure cavity.

Advantageously a compression spring is arranged between the base of the receiving recess, in particular the receiving ring groove and the radial back side of the interlocking protrusion, in particular the interlocking segment wherein the compression spring loads the interlocking protrusion a radially outward direction.

In order to facilitate interlocking and unlocking the interlocking protrusions include in particular interlocking segments interlocking protrusions interlocking protrusions that have a cross sectional contour at their radially outer end wherein the cross sectional contour includes a slanted front flank that is oriented into an axial extension direction wherein the front flank recedes in a radially outward direction into the axial insertion direction. The rear flank however is advantageously arranged at a right angle to the axial direction or even at an acute angle to the axial direction or it is a rear flank with shoulders.

The same applies analogously for the cross section configuration of the interlocking recess.

This way self-centering is performed when interlocking in the axial direction and for an acute angle configuration of the rear flank relative to the axial direction the interlocked condition even provides a form locking safety against radial inward movement and thus unlocking of the interlocking protrusion this however comes with increased fabrication complexity.

In order to be able to load the portion of the radially inward oriented surface of the interlocking protrusion that is not loadable directly from the first pressure cavity in a controlled manner with another pressure, namely from a second pressure cavity a supply cavity is provided in an interior of the piston rod, in particular of the piston end piece wherein the supply cavity is connected with the at least one supply recess for the guide protrusion of the move able interlocking protrusion.

The supply cavity is connected with a second pressure cavity connection which is typically arranged in an outer surface of the cylinder enveloping the piston rod typically the connection is provided through a connection cavity that is arranged between the supply cavity and the second pressure cavity connection and connects both of them.

In the inlet to the second pressure cavity connection or in the second pressure cavity connection typically an over pressure valve is arranged which prevents a pressure in the second pressure cavity rises above a maximum predetermined value which is typically not higher than the maximum pressure for which the second pressure cavity is configured.

Since a distance between the supply cavity in the piston or piston end piece and the second pressure cavity connection in the base of the enveloping cylinder changes with a change of an axial extension position of the piston rod the connection space is formed by the hollow interior in the axial direction by telescope able supply tubes that are run within each other sealed tight wherein one supply tube is attached at a rear free end of the piston rod, in particular of the piston end piece and attached axially rear ward extending and sealed tight and analogously thereto axially forward protruding from the cylinder base and concentrically aligned therewith another supply tube. The two supply tubes can be directly supported with one another sealed tight or one or plural intermediary tubes can be provided between the two supply tubes wherein the intermediary tubes however all together form a tight telescope able tube system.

Thus, the second pressure cavity is formed by the connection cavity and the supply cavity and the at least one guide recess connected therewith which extends to the supply protrusion supported tight therein.

The supply tubes supported inside one another in addition to providing a length variable connection of the supply cavity with the second pressure connection are also used to additionally stabilize the mechanical support between the piston rod and the piston wherein the mechanical support is otherwise only provided at the forward free end of the cylinder by the rod seal unit provided at this location and at the rear end of the piston optionally by the piston end piece which can be supported at the inner circumferential surface of the cylinder.

The supply tubes provide guidance on the one hand side in a portion between the piston end piece and the cylinder base and on the other hand side a mechanical sliding contact between an outer circumference of the piston end piece and the inner circumferential surface of the cylinder provided with the interlocking recesses can be omitted which otherwise comes with the risk of abrasion which could introduce impermissible solid material particles into the first pressure cavity wherein the solid material particles could cause damages and thus unnecessary replacement of the entire operating cylinder unit.

In case plural interlocking protrusions are provided in the piston, in particular in the piston end piece which shall be loadable with pressure independently from each other plural supply cavities are provided in an interior of the piston rod to supply the interlocking protrusions wherein the supply cavities shall be separately pressure loadable for example also respectively through a proprietary connection cavity, for example provided as supply tubes that are move able inside one another in a telescoping manner and connected with a respective proprietary pressure cavity in the cylinder base.

Since the operating cylinder unit is provided in several stages advantageously the first pressure cavity of all telescope stages are connected with each other and the second pressure cavities of all telescope stages as well.

Thus, the first pressure cavities on the one hand side and the second pressure cavities on the other hand side are respectively connected with a separate pressure generator or all together are connected with a single pressure generator, e.g. a hydraulic pump wherein a respective adjustable throttle is advantageously provided in the first pressure cavity connection as well as in the second pressure cavity connection wherein the throttle is advantageously adjustable also into the completely closed position and wherein the throttles are adjustable separately and independently from each other.

Additionally and independent from the previously described adjustable throttles an unlockable check valve is installed in a connection of each pressure cavity with its pressure generator. This unlockable check valve is made from a spring loaded check valve which can also designate as "fail safe" closure safety valve which is only unlocked against the spring preload when an oil control pressure or an electric pressure control signal is applied and which facilitates a controlled flow into the respective pressure cavity only under this condition. Thus when there is no control voltage or no control pressure from a pressure source the unlockable check valve closes the respective pressure cavity and locks the oil volume in the idle condition that is under a predetermined pressure at this time in the pressure cavity.

Advantageously a control is provided which controls the pressure generator, thus each pump and/or each additional provided valve, in particular also the unlockable check valve that is associated with each pressure cavity.

In order to provide precise control at least the pressure difference between the first pressure cavity and the second pressure cavity shall be known, Advantageously also the absolute values of the pressure in both pressure cavities wherein at least one differential pressure sensor is provided for this purpose which can measure the pressure difference and a direction of the radial pressure resulting force in particular at the guide protrusion between the first and the second pressure cavity.

Advantageously the pressure sensor is provided in the first pressure cavity as well as in the second pressure cavity wherein the pressure sensor measures the absolute pressure as well as a possibly provided differential pressure sensor that is signal connected with an advantageously provided and/or which forwards the measured value and the direction of the radial pressure resulting force, in particular at the guide protrusion to an optical display unit.

Advantageously a pressure relief valve is provided at least in the second pressure cavity in order to prevent the pressure in this second pressure cavity rises beyond a set pressure since the second pressure cavity is pressure load able up to a predetermined strength limit in particular due to its configuration by the described telescoping supply tubes and the smaller hydraulically active cross sections.

In case the operating cylinder device includes several of the described operating cylinder units an optionally provided control advantageously controls all operating cylinder units synchronously and/or all provided pressure generators, and/or all adjustable valves in particular the adjustable throttles.

When the individual operating cylinder units are operated as standalone devices or also the plural operating cylinder units of an operating cylinder device are operated individually with an individual pressure supply and individual manual actuation the synchronization is advantageously provided through a hand correction of the operator responsible for controlling the respective operating cylinder unit wherein the operator receives super ordinate control or correction instructions for example from a display connected with a central control or e.g. verbally from a corresponding control station.

When plural operating cylinder units are provided all first pressure cavity of all operating cylinder units can be connected with a first distribution cavity and all second pressure cavities of all operating cylinder units can be connected with a second distribution cavity, advantageously connected in an interrupt able manner wherein the two distribution cavities are pressure loaded advantageously through separate pressure generators, in particular pumps.

When plural provided operating cylinder units are jointly operated by a pressure generator for the first pressure cavities advantageously the synchronous lifting and lowering of the plural provided operating cylinder units at identical speed has to be assured in particular by elements which cause a volume metrically identical supply of all first pressure cavities.

In the connection from the distribution cavity to each individual first and second pressure cavity of each individual operating cylinder unit, however, advantageously a respective adjustable throttle is provided and the throttles are adjustable independently from each other and controllable independently from each other in case they are controlled by a control.

Instead it is also possible that all first pressure cavities and also all second pressure cavities of all operating cylinder units are only connected at a single joint distribution cavity, in turn with the throttles that are adjustable independently from each other with the first and second pressure cavities of each individual operating cylinder unit.

The joint pressure supply of the first and second pressure cavities can certainly not be provided when the individual operating cylinder units shall be operated as standalone devices individually with an individual pressure supply and an individual manual activation.

An operating cylinder unit of this type can furthermore include:

For example a position sensor for measuring an extension length and/or extension or lowering velocity wherein the position sensor is in particular arranged on an outside and parallel at the operating cylinder device and whose digitized encoder signal is connected with the previously described control. This measurement value feedback facilitates for example to maintain a set lifting or lowering velocity, wherein this control is essential for a precisely horizontal lifting and lowering of a load when plural operating cylinder devices are simultaneously and jointly operated by one control.

With respect to the method the object is achieved in that the individual method steps during operating an operating cylinder device, in particular the operating cylinder unit included therein like e.g. Extending the piston rod securing the axial position of the piston rod retracting the piston rod are performed according to the invention as follows.

Extending the piston rod is provided in that the first pressure cavity is loaded with a lifting pressure which is greater than an opposite force impacting the piston rod and the axial direction and the additionally provided internal friction forces of the operating cylinder unit. The extension velocity is furthermore controlled by adjustable throttles. The first pressure cavity is loaded with this lifting pressure until the predetermined nominal extension length of the piston rod and thus the nominal height of the load to be lifted is reached. The maximum extension lent of the piston rod or the telescope able piston rod is reached when the piston end pieces contact the associated rod sealing units mechanically.

Thus according to the invention the second pressure cavity is opened towards the tank so that during extension of the piston rod operating fluid can feed from the tank into the expanding second pressure cavity, in particular the second pressure cavity can draw operating fluid.

Alternatively the second pressure cavity is closed towards the tank but is supplied with additional operating fluid from the first pressure cavity however the connection between the first and the second pressure cavity is highly throttled so that the pressure provided in the second pressure cavity is much less than in the first pressure cavity and in particular is not much higher than the hydrodynamic friction of the oil conduits in the second pressure cavity, The pressure typically will be not be higher than 7 Bar, better not higher than 4 bar, better not higher than 3 bar.

Thus, it is important that the pressure provided in the second pressure cavity is low enough so that the interlocking protrusions loaded by the pressure are not run into the interlocking position.

An amount by which the lifting pressure exceeds the retaining pressure at which a force equilibrium is provided at the piston rod and the piston rod does not move in the axial direction also without mechanical safety is selected the higher the intended extension velocity of the piston rod.

Additionally an automatic mechanical fixation of the axial elevation is provided in case an uncontrolled drop of the lifting pressure occurs during an accident during the lifting process.

Thus, an advantageously adjustable check valve is arranged in the intake channel from the tank or in the throttled connection from the first pressure cavity to the second pressure cavity which prevents an on controlled quick retraction thus lowering of the respective operating cylinder unit upon a sudden drop of the lifting pressure in the first pressure cavity e.g. through collision or leakage of the first pressure cavity.

This is performed in that the second pressure cavity is closed by the check valve and a positive pressure that builds up in the second pressure cavity relative to the first pressure cavity moves the loaded interlocking protrusions into the interlocking position in a radially outward direction to the interlocking protrusion in the cylinder that are closest during retraction.

On the other hand side damage or destruction of the second pressure cavity by opening the previously described positive pressure valve in the second pressure cavity prevents exceeding a permissible maximum pressure.

In order to secure an axial position of the partially or completely extended piston rod relative to the surrounding cylinder and thus on each step of the multi-step operating cylinder unit initially the pressure in the first pressure cavity is lowered from the lifting pressure to a lowering pressure that is below the retaining pressure and the piston rod is retracted by a small distance, namely far enough until the interlocking protrusion is at a level of the next interlocking protrusion after the axial lowering has been commenced and can lock into this interlocking protrusion. Then the interlocking of interlocking protrusion and interlocking recess, thus of the safety elements is performed.

This interlocking of the safety elements is performed in that the radial outside as well as apportion of the radial inside of the radially movable safety element in particular of the movable interlocking protrusion is arranged within the first pressure cavity and is thus loaded by the lowering pressure prevailing at this location.

The remainder of the radial inside of the safety element, in particular of the interlocking protrusion is thus loaded from the second pressure cavity with an interlocking pressure which suffices together with an optionally provided additional interlocking force which can be provided by a mechanical force generator like e.g. a spring to press the interlocking protrusion radially outward into the interlocking recess.

This is reliably achieved according to the invention in that the check valve recited supra blocks the oil volume in the second pressure cavity in the supply conduit leading to the second pressure cavity when initiating the lower procedure and the pressure is increased up to the set value of the check valve so that the pressure increases significantly above the lowering pressure in the first pressure cavity and the radial displacement of the interlocking protrusions or safety elements into the interlocking recesses in the inner cylinder walls is caused by the high hydraulic excess pressure in the second pressure cavity over the first pressure cavity.

As soon as the interlocking protrusions are interlocked in the interlocking recesses the pressure in the first pressure cavity can be lowered further to 0 and the piston rod is then supported exclusively by the mechanical position safety. The oil volume in the second pressure cavity thus remains enclosed by the check valve and the pressure relief valve and provides that the mechanical interlocking is safely provided after cutting off any pressurized oil supply and opening the first pressure cavity and thus providing a permanent pressure drop to zero.

Alternatively or as a short term solution or as a precursor to the described securing of the axial position of the individual operating cylinder units through form locking interlocking of the interlocking protrusion in the interlocking step of each telescope stage in the respective interlocking recesses in the inner cylinder wall the respectively approached nominal lifting position can be safely maintained also for a longer time period in that the pressure supply and the control supply is simply turned off.

In this case the previously described unlockable check valves close for each first and second pressure cavity separately and individually from each other and thus close the respective pressure cavity and block the oil volume that is under a particular pressure at this time in idle condition in this respective pressure cavity hermetically.

This axial holding position can be maintained without any risk of unintentional lowering through defects or leakages of the pressure cavities also over a longer time period.

When there are damages to the pressure cavities, in particular to the external first pressure cavity and thus an uncontrollable sinking of the operating cylinder unit, the interlocking I protrusions recited supra immediately move hydraulically outward due to the pressure increase in the second pressure cavity due to the decreasing volume of the closed second pressure cavity caused by the retraction of the piston rod relative to the first pressure cavity and interlock in the next interlocking recesses and mechanically secure the hydraulically secured axial position by form locking interlocking wherein the axial position was previously only secured hydraulically until an accident occurs.

The fact that a small axial lowering of a few centimeters, typically at the most of up to 30 mm is insignificant for a horizontal distance from the adjacent support point of typically more than 12 meters since this corresponds to a slanted orientation of the 30 mm over 12,000 mm, thus 0.25%. The lifted product is not damaged in case there is a collision due to this mechanical safety of the axial position.

If the intentional simultaneous retraction of the mechanical safety is performed simultaneously at all three individual operating cylinder units used for lifting the load hardly any slanted orientation is generated as an average.

In order retract the piston rod from the axial position secured by axial interlocking the piston rod is initially extended by a small distance in order to axially lift the interlocking protrusions from the interlocking recesses in an axial direction and thus release the radial friction force caused by the axial form locking so that the radial inward movement and thus unlocking of the interlocking protrusions can be subsequently caused by a smaller force and the piston rod can be retracted after disengagement of the interlocking protrusions.

For this purpose initially the procedure is performed that is described for extending the piston rod. Subsequently the controllable check valve is put into the feed conduit to the second pressure cavity to a higher pass through pressure stage so that the outflow of the oil volume from the second pressure stage the interlocking pressure relative to the first pressure cavity is lowered far enough so that a resulting radially inward acting force upon the interlocking protrusion is provided.

As soon as all interlocking protrusions are moved in to the retracted unlocked position in this manner which can be monitored by optional sensors, thus position sensors at the individual interlocking protrusions the pressure in the first pressure cavity is lowered from the lifting pressure to a lowering pressure and the piston rod is retracted to the desired axial position optionally to the stop at the piston base.

This lowering process is caused by the applied weight of the load that was previously lifted by expelling the respective oil volumes from the two pressure cavities wherein the adjustment of the respective throttles yields the desired lowering velocity.

When lowering a load that is provided as an aircraft the lowering load of the aircraft is progressively reduced to zero as soon as the respective aircraft landing gear contacts the ground and the spring suspension generates an opposite force. Then it has to be assured that the inner friction forces of the operating cylinder unit are less than the weight of the piston rods including their accessories so that a head of the operating cylinder unit separates from a receiver of the aircraft in a lowest retracted position.

Thus, advantageously a retraction velocity of the piston rod can be controlled by a controlled throttle in the outlet of the first pressure cavity. The pressure in the second pressure cavity is kept significantly lower than the pressure in the first pressure cavity by opening the corresponding throttle so that a resulting radial inward force upon the interlocking protrusions is obtained and the interlocking protrusions cannot interlock in the mechanical blocking position during the controlled lowering.

When a measurement of the retraction velocity e.g. by a velocity sensor of the piston rod detects exceeding a predetermined value and the additional closure of the associated controlled throttle in the outlet of the first pressure cavity does not influence the excessively high sinking velocity anymore thus obviously an accident has occurred. The automatic mechanical position safety through radial extension of the interlocking protrusions into the next interlocking protrusions commences immediately as described supra.

Thus, in addition to the other installed safety mechanisms an excessively fast retraction, for example due to a defect or a partial dropping of the vertical position rod is prevented.

When extending and/or securing and/or retracting the piston rod the necessary steps can be performed sequentially for the individual telescope stages of the operating cylinder unit when the individual first and second pressure cavities of each operating cylinder unit are separately connected and loadable with pressure for this purpose.

Advantageously however in case of an automatic central control of all simultaneously operating cylinder units all first pressure cavities of all telescope stages of an operating cylinder unit and also all second pressure cavities are connected together at only one respective first or second operating cylinder unit and flow connected therewith.

This joint pressure supply of the first and second pressure cavities can certainly not be provided when the individual operating cylinder units shall be operated as standalone devices individually with an individual pressure supply and individual manual activation or remotely controlled by a control conduit from a central control.

During extension this has the effect that initially the first telescope stage extends with a full stroke until the mechanical stop is hit due to the typically largest hydraulically effective cross section and thereafter the next smaller diameter telescope stage down to the smallest telescope stage.

When retracting the piston rod retraction is performed in reverse sequence.

This has the advantage that in case of an incomplete extension of the operating cylinder unit primarily the telescope stages with a large cylinder and thus with a highest transversal stability are extended to the full lift height up to the upper mechanical stop which provides additional stand stability.

In case an operating cylinder device of this type includes plural operating cylinder units the following has to be considered when extending securing and retracting the individual piston rods of the individual operating cylinder units. Each operating cylinder unit shall be supplied with the same volume of pressure medium per unit time no matter whether the supply of the different operating cylinder units is provided through one or plural pressure generators.

Since interlocking between piston and cylinder is provided internally and not visible not visible externally but audible at best a display device is provided on an outside of the operating cylinder unit which also indicates correct interlocking of the safety elements from the outside or at least indicate pressure conditions in an interior of the operating cylinder unit which forces an interlocking of the safety elements.

A display device of this type includes on the one hand side a display element which advantageously makes the respective condition optically visible and a sensor element which detects the condition, thus in particular the pressure conditions in an interior of the operating cylinder unit and which controls the display element accordingly.

For this purpose the sensor element which is advantageously separately provided for each operating cylinder unit is connected at least with the second pressure cavity, advantageously with the first and also with the second pressure cavity in an interior of the operating cylinder unit.

A very simple display device includes a monometer that is easily visible and arranged on an outside of the operating cylinder device or lifting device which includes the operating cylinder device wherein the monometer is flow connected with the first pressure cavity or signal connected with a pressure sensor in this location and indicates the pressure at this location. When a monometer of this type indicates a pressure this means that the safety elements are exclusively interlocked or will interlock when they coincide in the axial direction with the next provided with the next interlocking recesses.

When the displayed element is connected with the two pressure cavities it can also indicate whether the higher pressure is provided in the first or second pressure cavity and when the higher pressure is provided in the second pressure cavity this means that the resulting force is directed towards the safety elements into the interlocking position.

For this purpose the sensor element is advantageously provided as s sensor piston that is movably supported in a sensor cylinder and loaded with pressure on each of its faces, thus in the sensor cylinder that is divided by the sensor piston into 2 operating cavities wherein the pressure loading is provided either from the first or the second pressure cavity of the operating cylinder unit.

Thus the sensor piston always contacts the stop that is remote from the operating cavity that is loaded by the higher pressure.

In an advantageous embodiment the sensor piston or an axially adjoining piston protrusion protrudes from the sensor cylinder and is visible when the piston protrusion contacts the end stop that is adjacent to the piston protrusion and this advantageously only occurs when the piston protrusion contacts the end stop.

For example when the end of that is arranged opposite to the sensor protrusion and the operating cavity at this location is connected with the second pressure cavity this means that the pressure in the second pressure cavity is higher than the pressure in the first pressure cavity and the safety elements are force loaded into the interlocking position or are already interlocked.

Since this is the intended safety this piston protrusion can be marked for example with the color green in the sense that the color green is a safe position.

If another piston protrusion protrudes exclusively or additional on the other side of the sensor piston the sensor piston should then advantageously be marked red indicating the unsecured position.

Instead or additionally a respective electric position sensor can be provided at or in the sensor cylinder and associated with one or both end positions of the sensor piston wherein the electric position sensor puts out an electric signal when the sensor piston is in a position that is adjacent to the corresponding electric position sensor.

The electric position sensor can emit a corresponding perceivable acoustic and/or optical signal using an electrical control, advantageously the signal is an optical signal from an illuminant like an led that is illuminated which is thus used as a display element but which can also be positioned without problems far remote from the sensor element of the display device and thus the remainder of the display device.

The ability to change position is important for example when the operating cylinder unit is used as a lifting device where the operating cylinder unit is attached upright in particular vertically oriented in the base frame of the listing device with a piston that is extensible in an upward direction from the cylinder and which lifts the load.

Since a lifting device of this type is often used an assembly building or maintenance building or other industrial environment there is always the risk of damaging the display device that is arranged externally at the lifting device which causes a risk of pressure medium exiting.

A lifting device of this type typically has support legs extending from the centrally arranged operating cylinder unit at a slant angle radially outward and downward wherein the support legs rest on the ground with their free lower ends.

The display device is then advantageously arranged at a level below the attachment portion of the support legs at the operating cylinder unit, advantageously in top view directly thereunder when the lower free end portion of the support leg is braced by a horizontal strut relative to the operating cylinder unit, advantageously between the horizontal strut and the support leg.

An electric display element like e.g. an illuminant provided as a LED can be arranged relative to this hardly visible position slightly above at the lifting device, thus at eye level and as required also with plural optical displays, thus illuminants distributed over the circumference of the operating cylinder unit so that the signal can be recognized from each position in the environment, thus the illumination or non-illumination of the advantageously monochromic illuminant or illumination or non-illumination of illuminants with different colors e.g. a red or a green illuminant.

Since the display device, in particular its hydraulically actuated sensor element is directly connected with the valve block and/or the cylinder of the operating cylinder unit in particular without the vulnerability of high level connections there between and the housing of the display device is furthermore attached at the valve block in a mechanically protected radially inner position a break off of the sensor element would open the conduits to the first and second pressure cavity and cause an immediate pressure drop.

Thus, however the catch safety described in the figure description would be activated due to pressure drop in the second pressure cavity and additionally additional hydraulic safety devices, in particular a respective unlockable check valve would be activated in each connection conduit between one of the two pressure cavities and the valve block and would close the respective conduit.

Since the hydraulic safety devices are arranged with optimum protection in an interior of the cylinder of their functionality is to be presumed.

Since the hydraulically actuated sensor element of the display device branches off from the connection conduits between the hydraulic safety elements and the valve block the hydraulic safety element would also be effective when the hydraulically actuated sensor element is torn off.

If an operating cylinder device includes plural operating cylinder units each operating cylinder unit advantageously includes at least sensor element, advantageously also a display element since it has to be separately detectable for each operating cylinder unit whether safe pressure conditions are provided between the two pressure cavities of the operating cylinder unit.

c) Embodiments

The invention is subsequently described in more detail with drawing figures, wherein:

FIG. 1*a* illustrates a two stage operating cylinder device in completely retracted position of both telescope stages in a longitudinal sectional view, thus cut in an axial direction along the line I.-I. of FIG. 2*a*.

FIG. 1*b* illustrates the operating cylinder device according to FIG. 1*a* in a completely extended condition of both telescope stages, FIG. 1*c* illustrates a blown up detail of FIG. 1*b*, FIG. 2*a* illustrates a face view of the operating cylinder device according to FIG. 1*a* through from a front in a direction II>a, FIGS. 2*b, c* illustrate sectional views along the line II. b or II. c according to FIG. 1*a*, the center tube of the operating cylinder unit 50 in a longitudinal sectional view in a face front view;

FIGS. 3*a, b* illustrate a cylinder configured as an individual component in a longitudinal sectional view and in a front view;

Figure 7A:
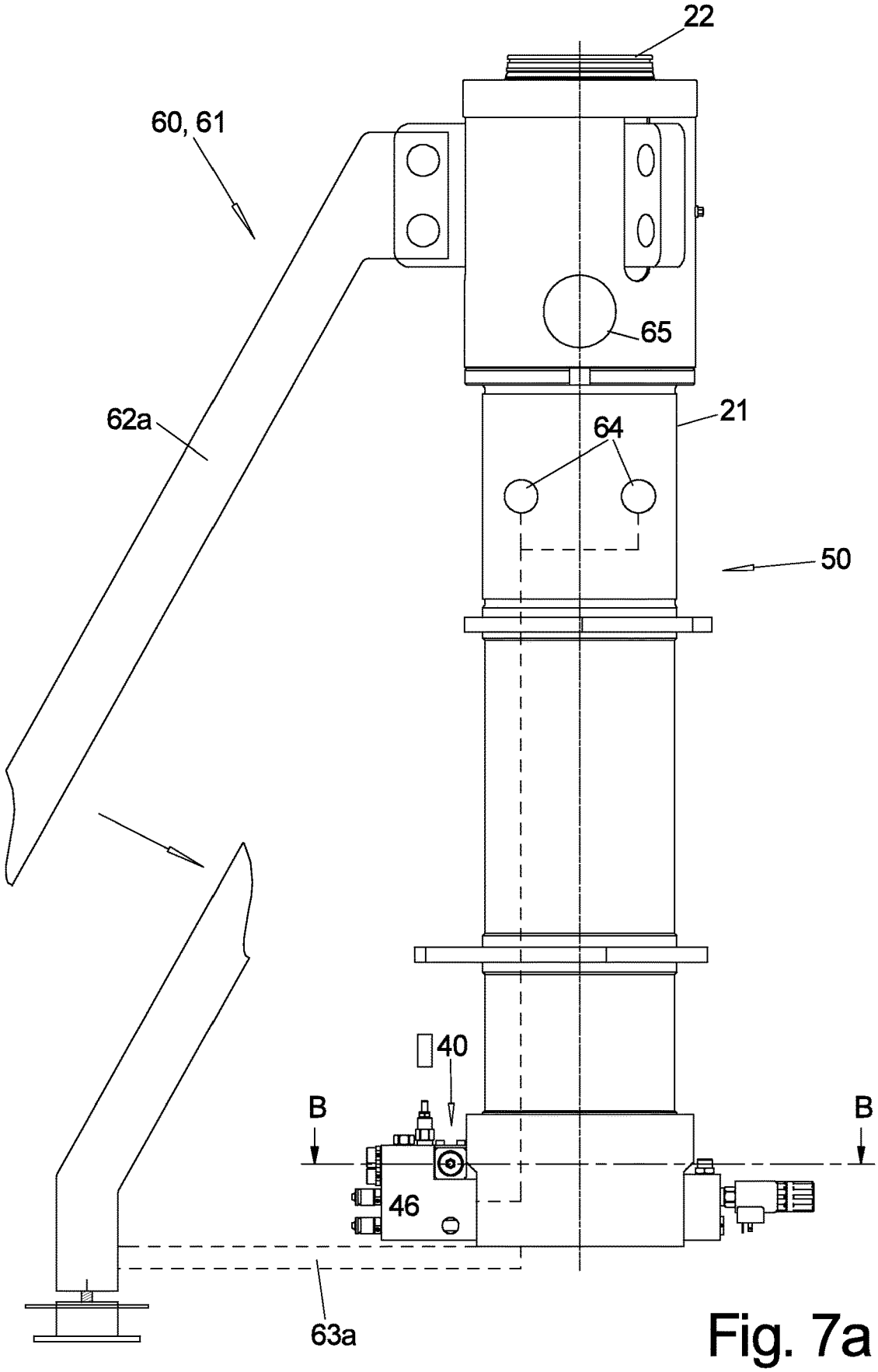

FIGS. 7*a, b* illustrate a display device that is installed at the operating cylinder unit in a side view and from above, partially cut.

Figure 8A:
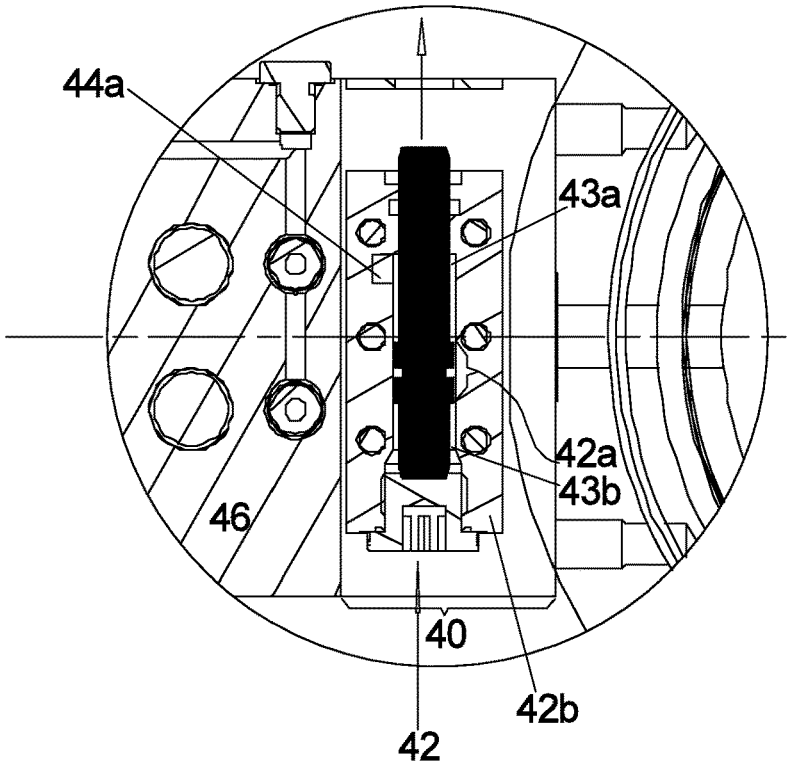

FIGS. 8*a, b* illustrate the sensor piston with only one exemplary piston protrusion in both end positions in a sensor cylinder that is cut in the longitudinal direction.

Figure 1A:
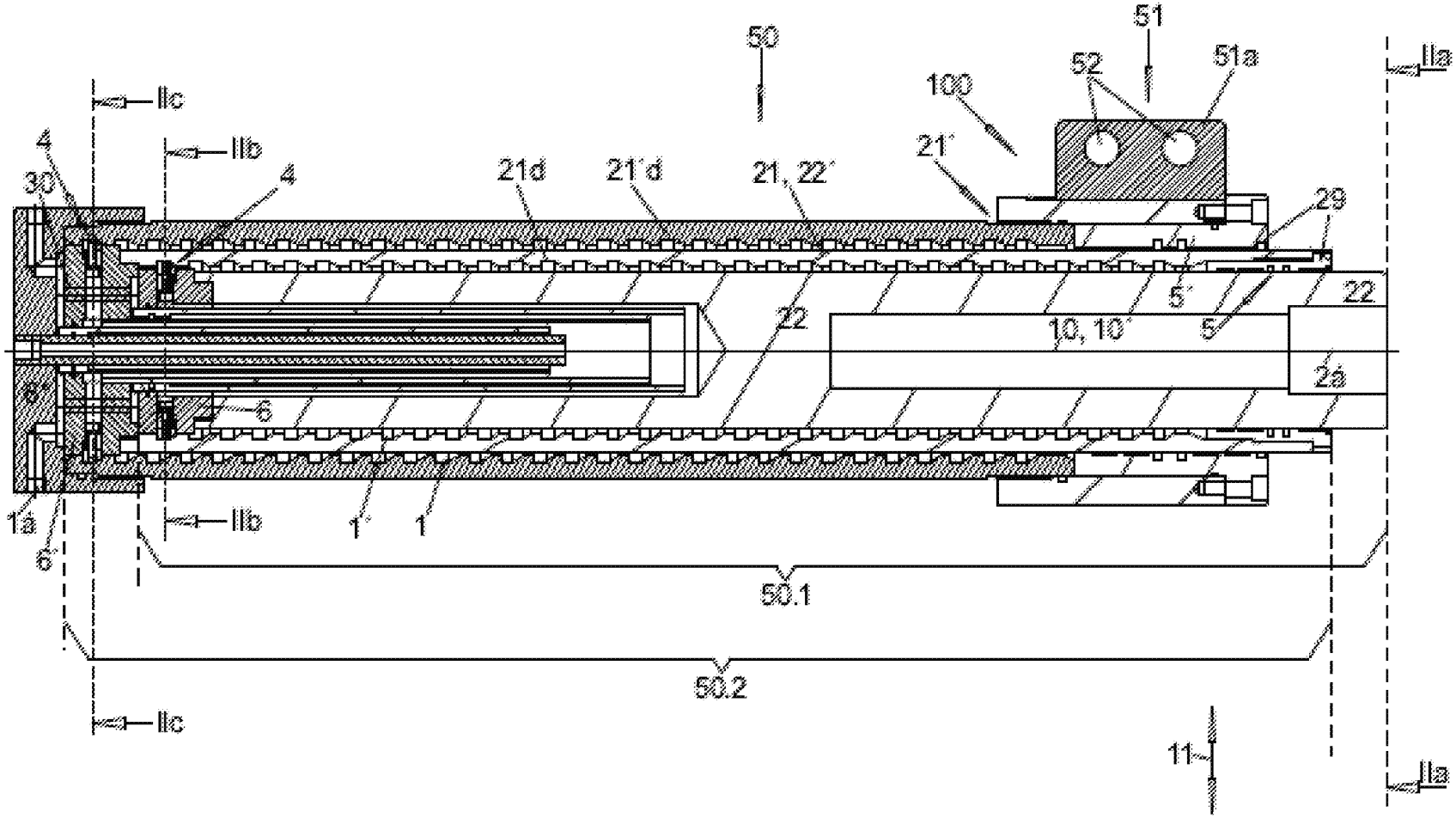
Figure 1B:
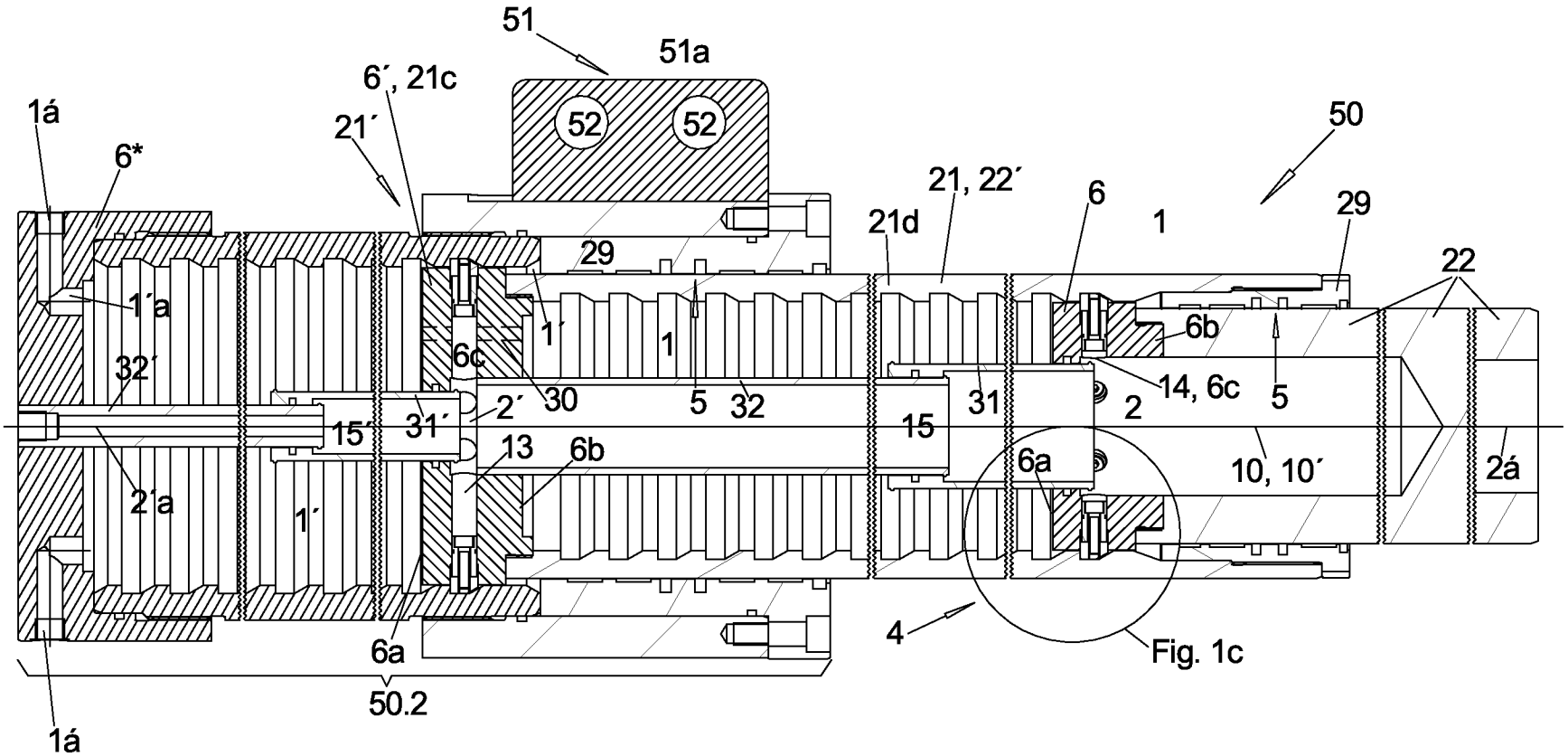

FIGS. 1*a* and 1*b* illustrate an operating cylinder device 100 in retracted condition and extended condition comprising a two stage operating cylinder unit 50 typically operated as a hydraulic cylinder unit 50 and in particular an attachment device 51 for attaching the operating cylinder unit 50 at an adjacent component.

As illustrated in the front view of FIG. 2*a* and in particular in the section al views of FIGS. 2*b, c* the operating cylinder unit 50 is configured rotation symmetrical about the longitudinal center 10' so that most of its components, the cylinders 21, 21' and the piston rod 22, 22' have a circular outer contour and/or inner contour.

In this case the attachment device 51 is attached at the outer most cylinder 21' in the radial direction and is made from three attachment plates 51*a, b, c* extending there from in the radial direction thus in the transversal direction 11 and extending in the axial direction 10 wherein pass through bore holes are provided in the attachment plates 51 *a, b, c* that are offset in the axial direction through which the attachment plates can be bolted to an adjacent component.

In this outer most cylinder 21' of the radially outermost telescoping stage 50.2 is as usual for multi stage operating cylinder units 50 an outer piston 22' is displace able in the axis direction 10 wherein the outer piston 22' simultaneously forms the inner piston 21 for the radially interior telescoping stage 50.1 and in which in turn an inner piston 22 is move able in the axial direction 10.

Figure 1C:
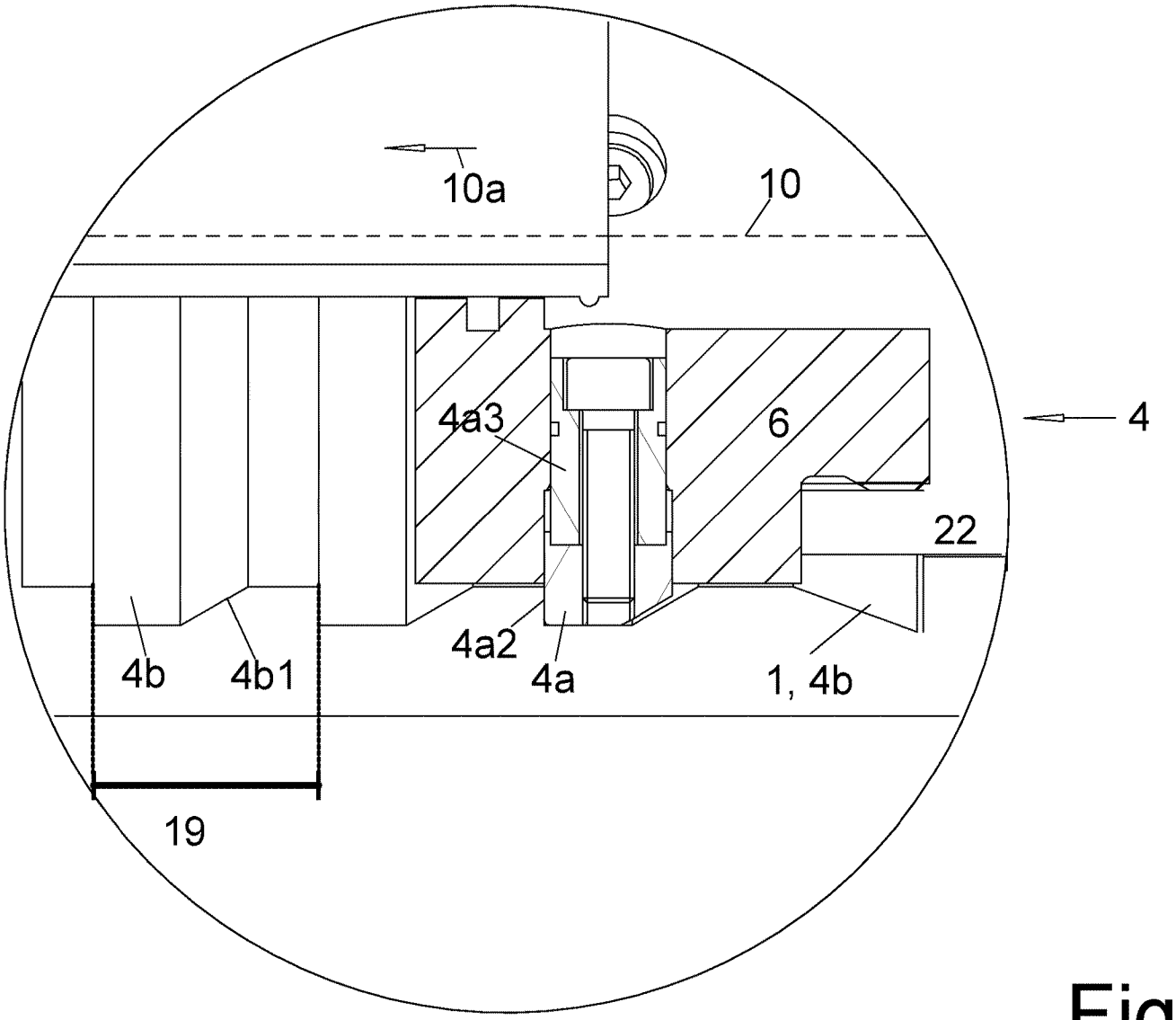

It is essential for the invention that the pistons 22, 22' are interlockable relative to their respective cylinder 21, 21' in both telescoping stages 50.1 and 50.2 respectively in a plurality of interlocking position along the axial direction in a form locking manner as a position safety 4 illustrated best in detail in the blow up of FIG. 1*c*.

For this purpose the rear portion of each cylinder 22, 22' includes interlocking elements that are extensive beyond its outer circumference an then are provided as interlocking segments 4*a* extending over a portion of the circumference which can interlock in an extended condition in corresponding interlocking recesses 4*b* a plurality of which is arranged behind one another in the radially opposite inner circumferential surface 21*a* of the surrounding cylinder 21, 21' in the axial direction 10. The interlocking recesses 4*b* are in this case advantageously configured as circumferentially extends interlocking ring grooves 4*b*.

In order to facilitate fabrication the interlocking segments 4*a* are respectively radially supported in a piston end piece 6 which is attached tight at a rear end of the otherwise tubular outer piston rod 22' so that it forms an inner cylinder 21 that is open at a front face and that receives the next inner telescoping stage 50. 1. By the same token the piston end piece 6 is attached at the radially interior piston rod 22 which is in this case not configured hollow in the pass through direction but only includes axial bore holes from both faces which protrude deeply in the axial direction into the piston rod 22.

Also the outer cylinder 21' is not integrally produced in one piece but has a tubular center element which is also closed tight at its rear end by a cylinder end piece 6* that is attached tight thereon.

The pistons 22, 22' are respectively operated as plungers, thus piston rods 22, 22' relative to the cylinders 21, 21' enveloping them radially wherein each cylinder 21, 21' includes annular circumferential rod sealing units proximal to its open face end respectively arranged in its inner circumferential surface 21*a*. The rod seal units 5 respectively include at least one annular circumferential elastic seal and axially adjacent thereto typically combined into one component, the seal sleeve 29 at least one so called support band that is also annular circumferential and supports and centers the piston rod 22, 22' wherein both slide ably contact the smooth outer circumferential surface 22*a* after respective piston rod 22, 22' functioning and piston seal surface 22*a* wherein the sliding movement is facilitated in the axial direction 10.

For this purpose the respective cylinder 21, 21' is respectively provided with a seal sleeve 29 that is attached tight at the tubular center element 21*d*, 21'*d* at its front end, in particular sealed tight wherein the an inner circumferential surface of the tubular center element forms part of the inner circumferential surface 21*a*, or 21'*a* of the respective cylinder 21, 21'.

Advantageously the inner circumferential surface of the seal sleeve 29 respectively includes plural ring grooves that are respectively offset in the axial direction 10 in which support bands and seals are arranged that protrude radially inward beyond the inner circumferential surface and which are not illustrated in the drawing figures.

Thus, a first pressure cavity 1 is formed in the first radially inner telescoping stage 50.1, wherein the first pressure cavity 1 is radially defined by the inner piston rod 22 and which is enveloped on the radial outside by the inner cylinder 21, wherein the first pressure cavity 1 is defined in the axial direction 10 by the rod sealing unit 5 at a front end of the cylinder 21 and the cylinder base 21*c* configured as the piston end piece 6 which is attached tight at the rear closed end of the cylinder 21 as evident from FIG. 1*b*.

Figure 3A:
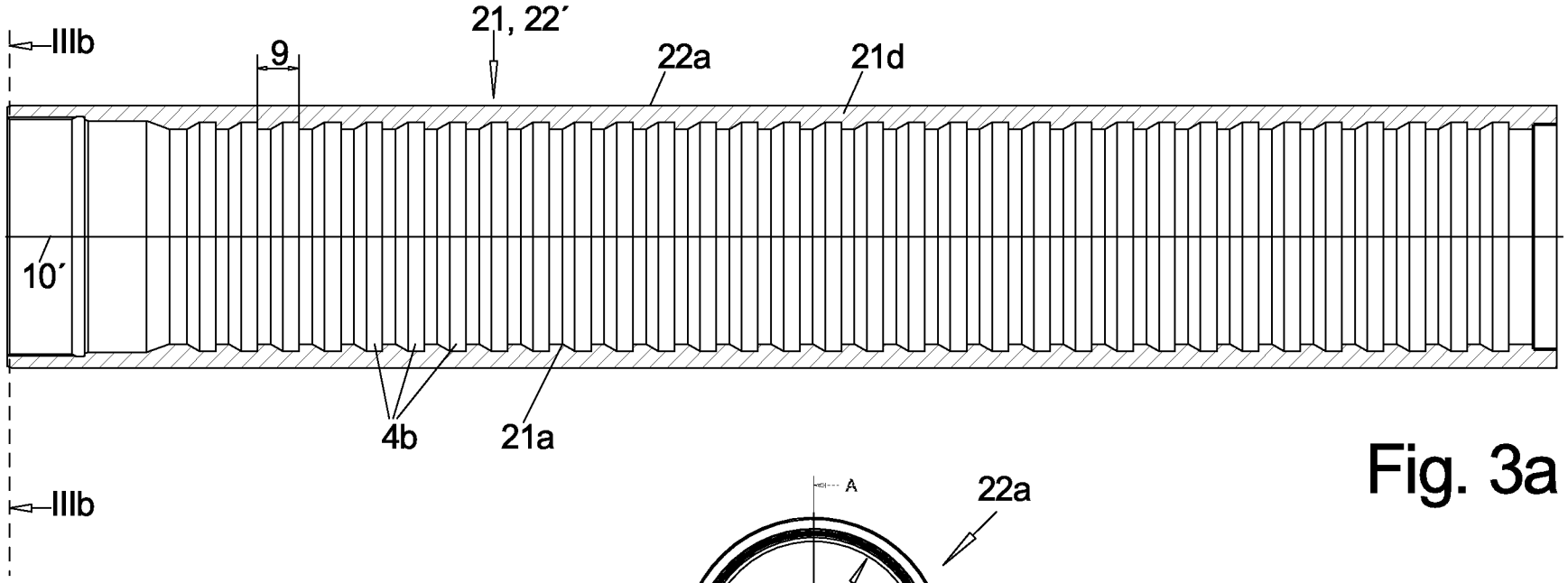
Figure 3B:
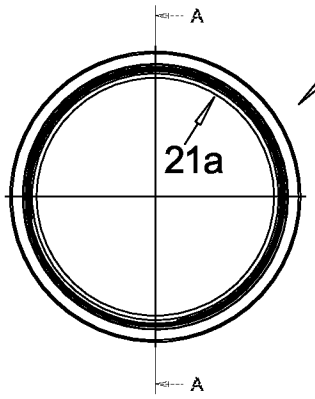
Figure 4:
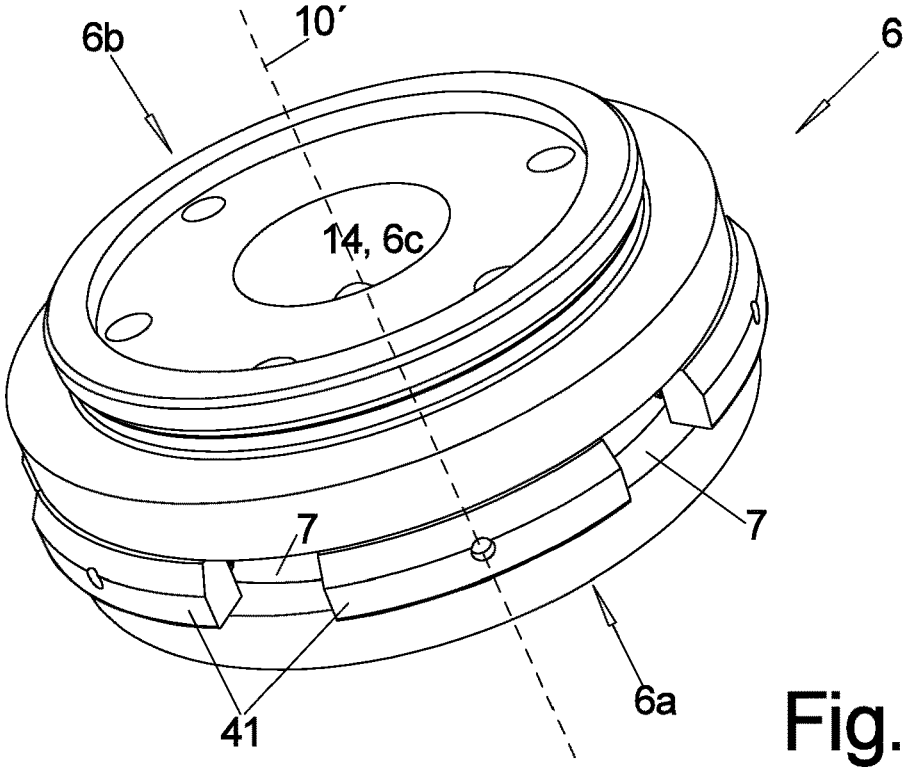
FIG. 4 illustrates a piston end piece in a perspective view with interlocking segments arranged thereon.

The center element 21*d* of the cylinder 21 of the radially interior first telescope stage 50.1 is illustrated in FIG. 3*a* in a longitudinal sectional view and in FIG. 3*b* in a front view.

Analogously a first pressure cavity 1' is formed in the radially outer second telescope stage 50.2 which is in turn defined in the radial direction by the piston rod 22' and the enveloping cylinder 21' and in the axial direction 10 by the rod sealing unit 5' arranged at the cylinder 21' at the forward open face end of the outer cylinder 21' and at a rear end by the cylinder end piece 6' attached tight at the center element 21'*d* of the cylinder 21'.

Theoretically the operating cylinder unit 50 could also be installed in a reverse manner and outward protruding portion of the innermost piston rod 22 instead of the outer most cylinder 21' in the illustrated condition can form the fixed component of the operating cylinder unit 50 that is arranged at an adjacent component in this case the attachment device 51 for attaching the operating cylinder unit 50 at an adjacent component would be attached the inner most piston rod 22 that extends freely out of the enveloping cylinder. This solution however has a number of disadvantages and is only used in exceptional applications.

The piston end pieces 6, 6' and the interlocking recesses 4*a* arranged thereon and provided as interlocking recesses 4*a* do not provide a seal between the piston where they are attached and the enveloping cylinder so that the respective first pressure cavity 1, 1' extends in the axial direction 10 in front and behind the piston end piece 6.

Each of the two first pressure cavities 1, 1' includes a first pressure cavity connection 1*a*, 1'*a* through which it can be supplied with the operating medium, typically a hydraulic medium and loaded with pressure.

In the radially outer first pressure cavity 1' the first pressure cavity connection 1'*a* is an inlet bore hole which extends through the cylinder end piece 6' and which is connectable on its outside with a non-illustrated pressure source.

The first pressure cavity connection 1*a* is provided for example as an axial pass through bore hole 30 which extends through the piston end piece 6' of the radially outer second telescope stage 50.2 and which connects the two first pressure cavities 1, 1' with one another.

Thus it is evident that the required mechanical processing of the inner circumferential surfaces 21*a* of the cylinders 21, 21' and on the other hand side of the outer circumferential surfaces 22*a* of the pistons 22, 22' which are partially identical is facilitated by the tubular shape of the center elements that is open on both sides.

On the one hand side the dual side face accessibility facilitates fabricating the ring grooves configured as interlocking recesses 4*b* which are arranged axially besides a short starting piece on both sides over the entire axial length 10 at a distance from each other that is as small as possible and provided with a cross section contour that is fabricated very precisely.

On the other hand side this also facilitates fabricating an outer circumferential surface 22*a* at a piston rod 22, 22' wherein the outer circumferential surfaces acts as a piston sealing surface.

The inner cross section is slightly enlarged compared to the center element at a face end that is illustrated on the left side of FIG. 3*a* in order to facilitate inserting the seal sleeve 29 at this location and the shoulder in the inner circumferential surface 21*a* at a right end of the tubular center element 21*d* is used for tight application of a piston end piece 6 at this location as illustrated in FIGS. 1*a, b*.

Figure 5:
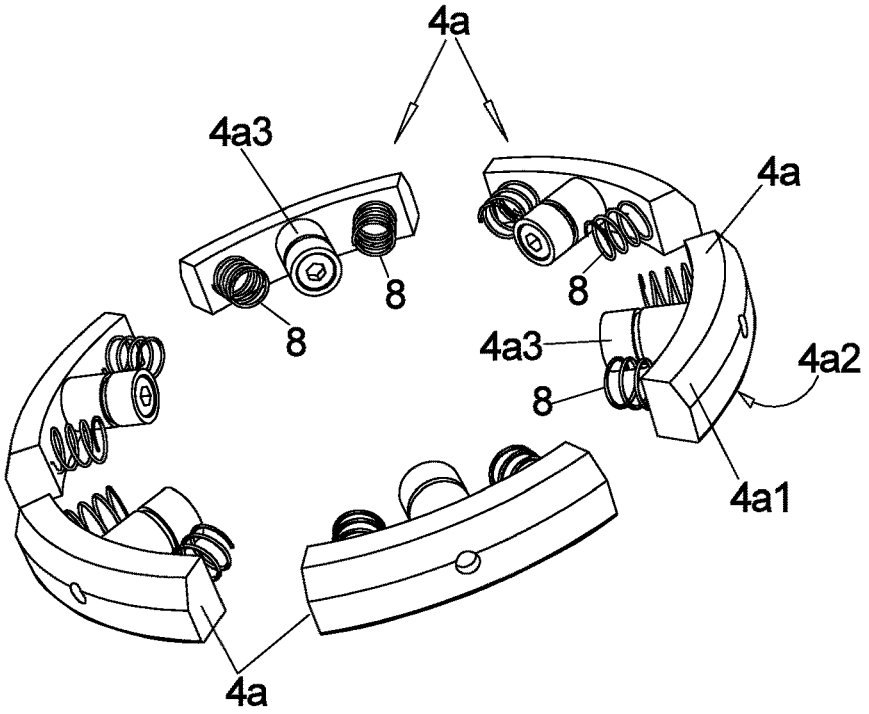
FIG. 5 illustrates the interlocking segments according to FIG. 4, however without the piston end piece.

The cross sectional shape of each of the interlocking recesses 4*b* and the cross sectional shape of the outer contour of the interlocking elements 4*a* which form a segment of a circular arc corresponding to the circular arc of the annular interlocking recesses 4*b* are illustrated best in FIG. 1*c* together with the perspective illustrations of the interlocking segments 4*a* in FIG. 5.

The annular interlocking recesses 4*b* are thus always arranged at a constant axial distance 19 from each other.

Here it is evident that each the interlocking annular grooves 4*b* has a cross section that includes a front flank 4*b*1 at an end that is in front in the axial direction 10 wherein the front flank is oriented at a slant angle to the axial direction 10 and approaches the axial direction 10 towards the longitudinal center 10' in the extension direction 10.

A rear flank 4*b*2 of each annular interlocking groove 4*b* is on the other hand side includes a surface, in particular an annular surface that is orthogonal to the axial direction 10.

The outer end of the rear flank 2*b*2 and rear end of the front flank 4*b*1 are connected by a center flank that extends in particular parallel to the axis direction 10.

An outer contour of each of the interlocking segments 4*a* is configured analogous to a front flank 4*a*1, a center element and a rear flank 4*a*2 which advantageously coincides with respect to a slant angle of the front flank 4*a* with the inclination of the front flank 4*b*1 of the circular interlocking groove 4*b*.

Also the dimensions are selected so that the interlocking segment 4*a* can interlock in one of the annular interlocking recesses 4*b*.

All recited flanks are circular ring shaped or circular segment shaped on a side of the interlocking segments 4*a*, due to the rotation symmetrical configuration in the axis direction 10 as evident in particular from FIG. 5.

In the illustrated embodiment each piston end piece 6, 6' includes 6 interlocking segments 4*a* in a receiving ring groove 7 that is fabricated in its outer circumference wherein the interlocking segments are evenly distributed over a circumference and precisely fit into the receiving ring groove 7 with respect to axial and radial extension so that the interlocking segments are supported by the ring groove and can penetrate into the ring groove so that they so not protrude radially beyond an outer circumference of the piston end piece 6, 6'.

As illustrated in FIGS. 5 and 1*a, b* a cylindrical support protrusion 4*a*3 protrudes from a radially inner back side of each of the interlocking segments 4*a* that is fixed at the interlocking segment and thus protrudes radially inward and is supported tight in the radial direction in a corresponding cylindrical support recess 13 of the piston end piece 6, 6', e.g. in that an O-ring seal is inserted in the annular groove that is visible in the outer circumference of the support protrusions 4*a*3.

The radially extending support recesses 13 penetrate the annular or sleeve shaped piston end pieces 6, 6' from an inside out and are thus connected with one another through its central inner cavity 6*c* which penetrates the piston end piece 6, 6' from its rear end 6*a* to its front end 6*b* due to its sleeve shape.

A respective compression spring 8 is also arranged at a radially inward oriented back side of each of the interlocking segments 4*a* on both sides adjacent to the support protrusion 4*a*3, wherein the compression spring acts in the radial direction and is supported with its inner free end at the base of the receiving ring groove 7 so that the annular segments 4*a* are loaded in a radially outward direction.

Without further force impact in a piston end piece 6, 6' whose interlocking segments are arranged at an axial position of an external enveloping interlocking ring groove 4*b*. The interlocking segments 4*a* would engage the enveloping annular interlocking recess 4*b* due to a force of the springs 8 as evident also in the cross sectional illustration of FIGS. 2*b*, 2*c* which illustrate this interlocked condition for the radially inner first telescoping stage 50. 1 (FIG. 2*b*) and on the other hand side for the radially outer second telescoping stage 50.2 (FIG. 2*c*).

In practical applications, however, the interlocking segments 4*a* are not only pressed radially outward by a force of the springs 8 but in particular by pressure loading of the inner cavity 6*c* of the piston end piece 6 which thus also impacts a rear free face of each of the support protrusions 4*a*3 when the inner cavity 6*c* which acts as a supply cavity 14 for the support recesses 13 of the piston end piece 6, 6' is loaded with pressure.

This can be provided in that the inner cavities 6*c* of the piston end pieces 6 as evident form FIG. 1*b* form a component of a respective second radially inward pressure cavity 2, 2' which are also connected with each other.

Thus, the inner cavities 6*c* of the two piston end pieces 6 are connected pressure tight with each other in that a telescope tube arrangement is provided between the two of them which telescope tube arrangement extends in the axial direction and includes a supply tube 32 that is movable tight therein, wherein a first supply tube is attached tight at a piston end piece 6 and leads into its inner cavity 6*c* and thus into its supply cavity 14 and the other is attached analogously in the piston end piece 6' and terminates in its inner cavity 6*c* and supply cavity 14.

Between the rear end 6*a* of the axially rear piston end piece 6, 6' and a axial pass through bore hole of the cylinder end piece 6* another telescope tube arrangement is provided which includes an outer supply tube 31' and a sealed inner supply tube 32' supported therein and connected with a connection opening in the outside of the cylinder end piece 6' which forms the second pressure cavity connection 2'*a* for this second pressure cavity 2.

The second pressure cavity connection 2'*a* and the two telescope tube arrangements 31, 32, 31', 32' are advantageously centrally arranged, thus concentric to the longitudinal center 10'.

The piston end piece 6 that is in front in the axial direction 10 could also be closed at the front end 6*b* and this piston end piece 6 cannot be sleeve shaped but has to be pot shaped, but the sleeve shape is selected for fabrication reasons and the piston end piece 6 is introduced tight, in particular threaded into a dead hole that is introduced into a rear face of the axially inner piston 22.

The dead hole that is visible in FIG. 1*a* and extends from the front face of the inner piston 22, however is merely a mounting option for an adapter part that is not illustrated in the drawing figures and applicable to a front end of the piston rod 22 in order to adapt to various interfaces of the loads to be received.

Thus, the second pressure cavity 2 that is in front in the axial direction and includes essentially the inner cavity 6*c* of the forward piston end piece 6 and the dead hole in the rear end of the piston rod 22 is connected through a connection cavity 15 adjoining its rear second pressure connection 2*a* which is formed by the inner space of the first telescope tube arrangement 31+32 with the rear second pressure cavity 2' which is essentially formed by the inner space 6*c* of the rear piston end piece 6' and this in turn is connected through another connection cavity 15' formed by the inner cavity of the second telescope tube arrangement 31'+32' with the second pressure cavity connection 2'*a*.

The second pressure cavity connection 2*a* of the forward first pressure cavity 2 is formed by the outlet of the connection cavity 15 in the forward piston end piece 2.

Thus, the continuous radial inner second pressure cavity 2, 2' can be supplied with pressure through the second pressure cavity connection 2'*a* in the outside of the piston end piece 6' and the continuous first pressure cavities 1, 1' can be supplied with pressure through the at least one first pressure cavity 1'*a* that is illustrated in the outer circumferential surface of the cylinder end pieces 6'.

Figure 6:
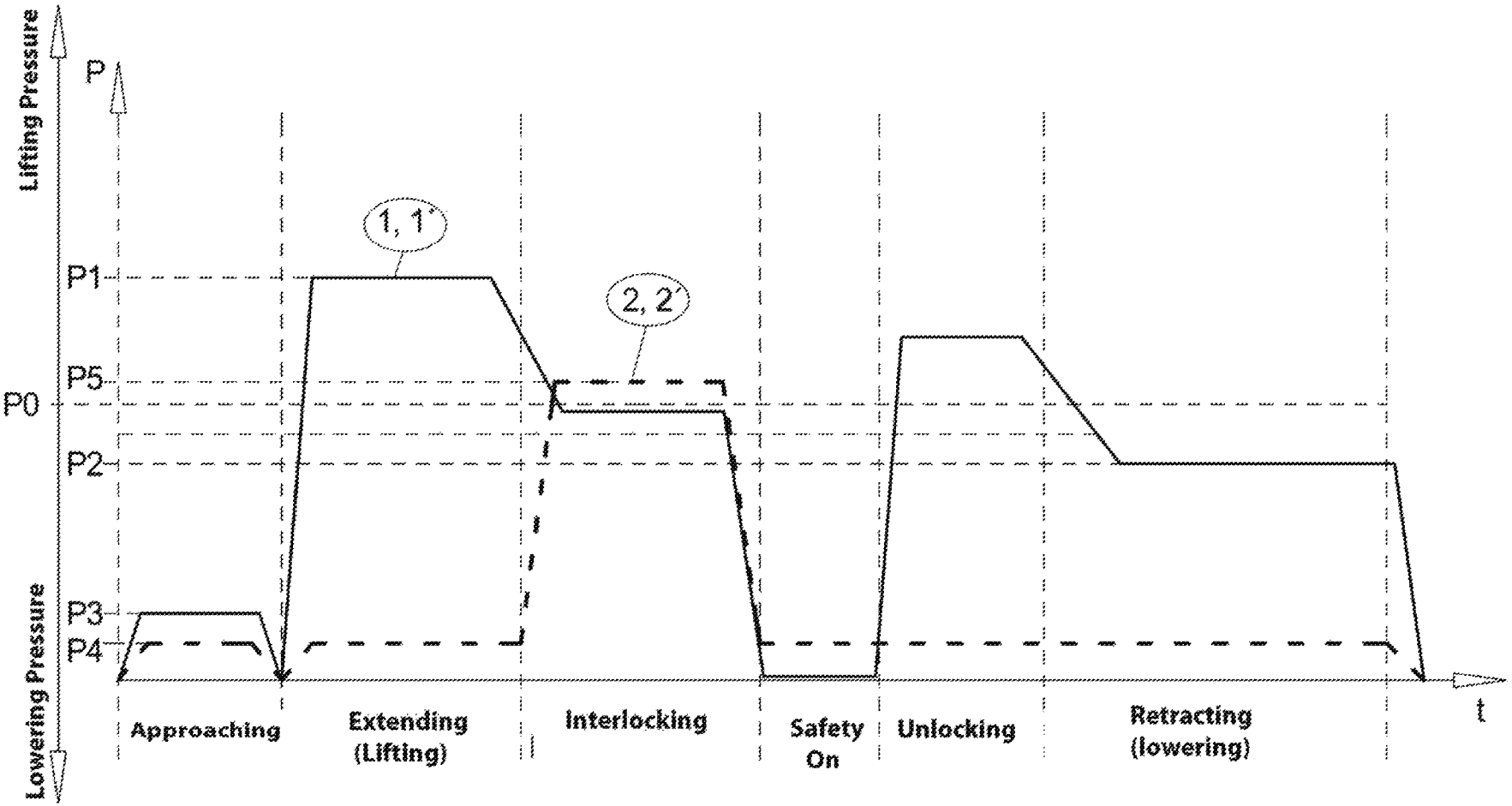
FIG. 6 illustrates a pressure distribution in the two pressure cavities of the operating cylinder unit according to the preceding figures in various operating positons.

This can be used to hydraulically extend the piston cylinder unit 50 and to retract through the load and thus to interlock the piston rods 22, 22' at one of the annular interlocking recesses 4*b* of the respectively adjacent radially enveloping cylinder 21, 21' in a form locking manner, wherein the pressure conditions prevailing in the individual operating conditions are illustrated in FIG. 6.

FIG. 6 illustrates for the individual pressure cavities 1, 1 on the one hand side and 2, 2' on the other hand side a pressure diagram from start of operations through lifting and securing of a load resting on the operating cylinder device 100 and thus the operating cylinder unit 50 until the operating cylinder unit 100 is shut down.

Thus, idle pressure p0 is the pressure that has to be provided in the first pressure cavity 1, 1' in order to keep a load vertically stable that rests on the operating cylinder unit 50 without mechanical position safety thus to neither lift the load any further or lower it any further.

Initially the load contact surface, typically an upper end of the vertically arranged operating cylinder unit is distance between the load L to be lifted.

Approaching load pick up point:

Therefore the first pressure cavity 1, 1' is loaded initially with a very small contact pressure P3 which suffices to compensate the tare weight of the telescope stages and the inner friction and to extends the first rod slowly without load, for example three bar and thus extended without load until the load contact surface of the operating cylinder unit 50 contacts the load.

Thus, the pressure in the second pressure cavity 2, 2' is kept lower and thus low enough so that the interlocking protrusions, in particular the interlocking segments 4*a* are with respect to the receiving ring groove in the radially inward moved deactivated position and when springs 8 are provided also in view of their spring force.

The described approaching of the load receiving point is performed for plural operating cylinder units 50 in sequence with all typically three operating cylinder units 50 which shall be used for horizontal synchronous lifting of the load.

Extension (load lifting):

After all, typically three operating cylinder units 50 which shall be used for horizontal synchronous lifting of the load have contacted the load L at its respective receiving point loading lifting can be commenced.

The subsequent method description typically relates to 3 operating cylinder units 50 that provide a synchronous vertical movement of the load that is to be kept horizontal.

It is appreciated that the method steps subsequently described for an operating cylinder unit 50 have to be performed in parallel and synchronously with all operating cylinder units 50 that contribute to the horizontal, vertical movement of the load.

The pressure in the first pressure cavity 1, 1' is increased to a lifting pressure p1 which is higher than the idle pressure p0 and this lifting pressure p1 is maintained until the load is lifted to the desired height. The fine adjustment of the lifting pressure p1 determines the lifting velocity.

The pressure in the second pressure cavity 2, 2' remains in any case lower than the lifting pressure P1, in particular lower than the idle pressure p0 and in particular also lower than the contact pressure p3, advantageously at the same level as the base pressure p4 which was already provided in the second pressure cavity 2, 2' when contacting the load.

Either the load is lifted to an axial lifting position which is in particular approximately 20 mm above the intended nominal lifting height and/or a difference that is less than the distance 9 of the interlocking recesses 4*b* that are adjacent to each other in the axial direction 10.

Alternatively all telescope stages, in the instant embodiment 2 telescope stages are extended until they reach their inner mechanical end stop, namely the inner lower annular edges of the seal sleeves, 29, thus to the maximum extended position.

When a nominal lifting height shall be approached which shall not be secured by mechanical interlocking in a form locking manner and thus the function of the unlockable check valves shall be used. The nominal lifting height can be approached precisely before switching off and the subsequently described procedures of interlocking securing and unlocking before lowering two the nominal lifting height can be omitted.

This method simplification is in particular owed to the fact that unintentional pressure drop in the first pressure cavity which controls lifting and lowering of the load automatically triggers the form locking interlocking through hydraulic extension of the interlocking protrusions into the next interlocking recesses in the second pressure cavity through pressure increase in the second pressure cavity due to its volume reduction. The second pressure cavity is completely enveloped by the first pressure cavity. Damaging the second pressure cavity through external influences is therefore excluded.

Interlocking:

Since all telescope stages 50.1 and 50.2 of the operating cylinder unit 50 shall be interlocked in a form locking manner at the nominal lifting height the at least one piston rod 22, 22' is slightly retracted again from this condition in that the pressure in the operating cavity 1, 1' is lowered until slightly below the idle pressure p0 while the pressure in the second pressure cavity 2, 2' is increased to the interlocking pressure which causes a radial extension of the interlocking segments 4*a* and which is for this purpose advantageously also significantly above current pressure in the first pressure cavity 1, 1'.

Thus, the at least one piston rod 22, 22' is slightly retracted until the radially outward loaded interlocking segments 4*a* of the piston rods 22, 22' interlock in the next interlocking recess 4*b* in retraction direction.

Secured:

As soon as this is achieved which can be advantageously monitored automatically by corresponding sensors the pressure in the operating space 1, 1' can be lowered, advantageously down to 0 in the condition that is reached now and secured in a form locking manner.

It is only important that the pressure in the pressure cavity 2 is kept high enough which can be kept under the interlocking pressure P5 so that the interlocking elements 4*a* are still loaded in the radially outward direction also in view of the springs 8 that are possibly provided and/or the friction loses and adhesion friction between the safety elements 4*a* and the piston end piece 6.

Thus, advantageously the pressure in the pressure cavity 2, 2' in the secured condition is above the pressure in the first pressure cavity 1, 1'. The supply cavities of the two pressure cavities 2, 2' and 1, 1' are then advantageously closed by the unlockable check valves that are provided according to the invention. The pressure generation can then be cut off.

Unlocking:

When the condition of supporting the load based on form locking interlocking shall be terminated initially the interlocking segments 4*a* have to be unlocked from the interlocking recesses 4*b* for this purpose, thus before retracting the at least one piston rod 22, 22' so that the piston cylinder unit 50 is disengaged from the load.

After the pressure generation is turned on again the unlockable check valves open automatically and facilitate pressure oil supply to the first and second pressure cavity.

In order to remove the contact pressure in axial direction between the rear flank 4*a*2 and the corresponding rear flank 4*b*2 of the interlocking recess 4*b* the at least one piston rod 22, 22;' is initially extended a little more.

Thus, the pressure in the first pressure cavity 1, 1' is raised to a lifting pressure above the idle pressure P0 which furthermore has to be high enough so that forces impacting the interlocking segment 4*a* from a radial outside thus from the first pressure cavity 1, 1' are greater than all forces impacting from the radial inside, thus from the second inner pressure cavity 2, 2' which can also include the force of the springs 8 besides the pressure in the second pressure cavity 2, 2'.

Advantageously the pressure in the second pressure cavity 2, 2' is set to the safety pressure P4 that is much lower than the idle pressure P0.

Retracting (lowering):

As soon as the safety elements 4*a* are retracted to the radially retracted deactivated position the pressure in the first pressure cavity 1, 1' is lowered for retracting the piston rods 22, 22' to a lowering pressure P2 below the idle pressure P0. The value of the lowering pressure P2 is selected as a function of the desired lowering speed.

In this condition it only has to be assured that a resulting force is applied in a radially inward direction upon the interlocking segments 4*a* also in view of the pressures in the first pressure cavity 1, 1' and the second pressure cavity 2, 2' that impact the interlocking segments from the radial inside and from the radial outside.

Typically the pressure in the second pressure cavity 2, 2' is kept significantly below the pressure in the first pressure cavity 1, 1' for this purpose and advantageously the pressure in the second pressure cavity 2, 2' is kept at a level of the securing pressure P4, whereas the lowering pressure in the first pressure cavity 1, 1' is much higher.

After the piston rods 22, 22' have reached the completely retracted position thus their end pieced 6, 6' contact the base of the enveloping cylinder 21, 21' the pressure in both pressure cavities 1, 1' and 2, 2' can be lowered to 0 and thus also the at least one pressure generator supplying the operating cylinder unit 50 can be turned off.

FIGS. 7*a, b* illustrate a side view and a top view of a lifting device 60 where the operating cylinder unit 50 is the load lifting element standing upright with a piston 22 that is extendable in the upward direction from a cylinder 21 wherein the load lifting element is installed in a base frame 61.

The base frame 61 essentially includes 3 attachment lobes that are essentially distributed over a circumference of the cylinder 21 and arranged in an upper portion of the cylinder 21 wherein a support leg is respective attachable at the attachment lobes with a downward outward slanted slope, wherein only one support leg is drawn in FIG. 7*a* for reasons of clarity.

Each support leg 62*a, b, c* contacts the ground with a lower end with an elevation adjustable support base while the centrally arranged operating cylinder unit terminates at a distance above ground.

Between the lower end of the operating cylinder unit 50 and the lower end portion of each support leg 62*a, b, c*, an additional horizontal strut 63*a* or *b* or *c* can be arranged for stiffening.

The first display device 40 is bolted down at a lower end of the operating cylinder unit 50, thus at the cylinder base and thus well protected by the support legs 62 *a, b, c* protruding far outward in this elevation range and optionally one of the horizontal struts 63*a-c* extending thereunder.

Figure 7B:
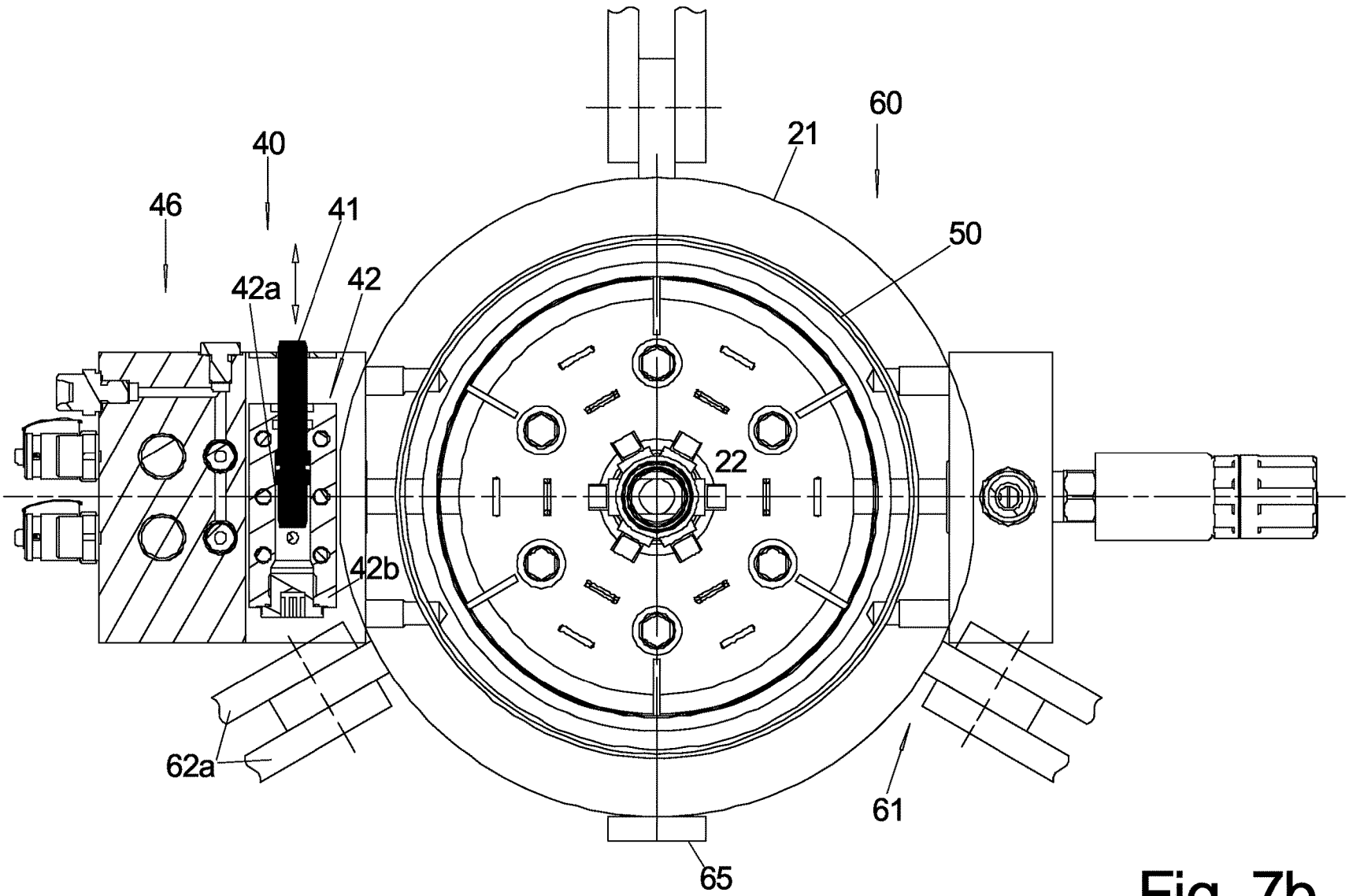

As evident already from the top view of FIG. 7*b* of the cut display device 40 and even better from the detail enlargements according to FIGS. 8*a, b* the display device 40 includes a sensor cylinder 42*b* as a sensor element 42 wherein a sensor piston 42*a* is displace able in the sensor cylinder 42*b* depending in which of the two operating cavities 43*a, b* of the sensor cylinder 42*b* the higher pressure is provided.

As evident from FIG. 8,*b* the sensor cylinder 42*b* whose axial direction 42' extends horizontally in this case which however is not mandatory for the invention is only closed at one end by a closure plug that is threaded in sealed tight so that the sensor piston 42*a* can be replaced after removing the closure plug.

At another axial end the sensor cylinder 42*b* has a pass through opening that is arranged concentric with the axial direction 42' of the inserted sensor piston 42*a* with at least one seal in the inner circumference.

The sensor piston 42*a* includes a one piece piston protrusion 42*a*1 which extends in the axial direction 42' and which is long enough so that it protrudes through the pass through opening and even out of the housing 45 of the display device 40 so that the end of the piston protrusion 42*a*1 is visible for the user and shows a correct interlocking or at least a correct pressure loading of the safety elements 4*a*.

Figure 8B:
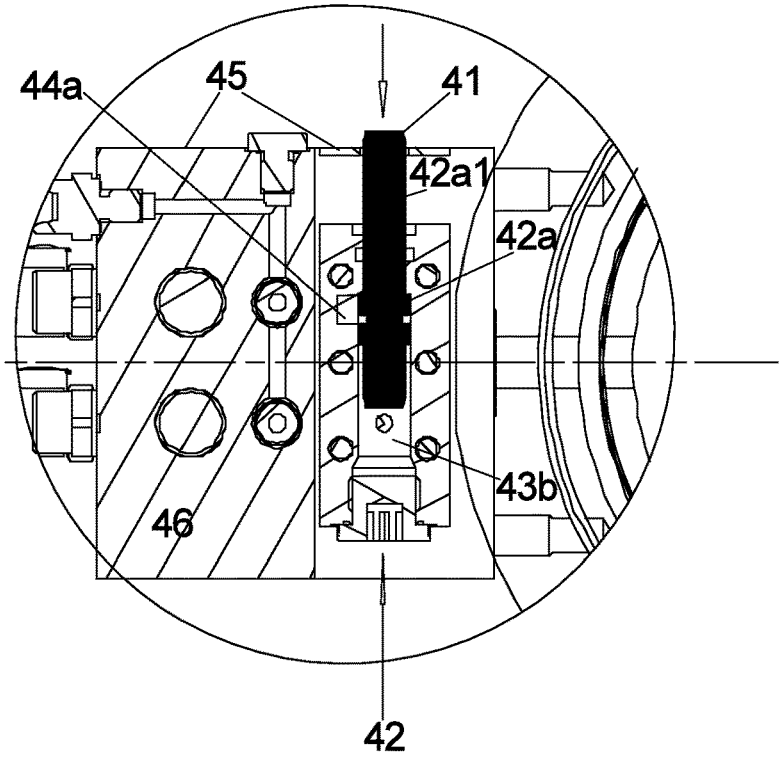

Thus, the sensor piston 42*a* that is supported tight in the inner circumference of the sensor cylinder 42*b* contacts the upper end stop in FIG. 8*b* which occurs when the lower operating cavity 43*b* is loaded with a higher pressure from the second pressure cavity 2, than in the pressure provided in the first operating cavity 43*a* from the first pressure cavity 1.

However, when the pressure in the upper operating cavity 43*a* in the drawing is greater the sensor piston 42*a* assumes the other end position according to FIG. 8*a* in that it contacts with its lower end in the drawing figures the closure plug closing the inner cavity of the sensor cylinder 42*b*.

The required connection of the upper operating cavity 43*a* in FIGS. 8*a, b* with the first pressure cavity 1 and of the lower operating cavity 43*b* with the second pressure cavity 2 are not illustrated in the drawing figures.

FIGS. 8*a, b* furthermore illustrate the position sensor 44*a* for the secured position that is arranged in the sensor cylinder 42*b* proximal to the upper end stop in the drawing figures wherein the position sensor puts out an electrical signal when the sensor piston 42*a* is at this stop and there after a LED 64 is illuminated by a control, which LED is arranged further upward at the outer circumference of the operating cylinder unit 50 and which is advantageously provided in the same color in which the free end of the piston protrusion 42*a*1 is provided, advantageously green.

FIGS. 7*a, b* furthermore illustrate a second display device 40 configured as a manometer 65 which can be provided instead of or in addition to the first display device described supra.

The manometer 65 is in this case provided at an outside of the cylinder 40, advantageously in its upper portion, thus approximately at eye level of an operator standing next to the lifting device.

The manometer 65 indicates the pressure in the first pressure device 1, 1' which would load the safety elements in a direction of an unlocked deactivated position. When this manometer 65 shows a pressure of zero or almost zero, in particular under 0.5 bar this assures that the safety elements are not pressure loaded towards the unlocking direction.

REFERENCE NUMERALS AND DESIGNATIONS

1, 1' first pressure cavity
1*a*, 1'*a* first pressure cavity connection
2, 2' second pressure cavity
2*a*, 2'*a* second pressure cavity connection
3, 3* face
4 position safety
4*a* safety element, interlocking protrusion, interlocking segment
4*a*3 support protrusion
4*a*1, 4*b*1 front flank
4*a*2, 4*b*2 rear flank
4*b* safety element, interlocking recess
5, 5' piston rod seal unit
6, 6' piston end piece
6* cylinder end piece
6*a* rear end
6*b* front end
6*c* inner cavity
7 receiving ring groove, receiving groove
8 compression spring
9 axial distance
10 axial direction
10*a* extension direction
10' longitudinal center
11 radial direction, transversal direction
12 circumferential direction
13 support recess
14 supply cavity
15 connection cavity
19 distance
21, 21' cylinder
21*a* inner circumferential surface
21*b* cylinder inner space
21*c* cylinder base
21*d* center element
22, 22' piston rod
22*a* circumferential surface, outer circumference piston seal surface
23 throttle
24 throttle
28 pressure relief valve
29 seal sleeve
30 pass through bore hole
31 outer supply tube
32 inner supply tube
40 display device
41 display element
42 sensor element
42*a* sensor piston
42*a*1 piston protrusion
42*b* sensor cylinder
43*a, b* operating cavity
44*a* position sensor
45 housing
46 valve block
50 hydraulic cylinder unit, operating cylinder unit
50.1, 50.2 telescoping stage
51 attachment device
51*a, b* plate
52 pass through bore hole
60 lifting device, tripod
61 base frame
62*a-c* support leg
63*a-c* horizontal strut
64 illuminant LED
65 manometer
100 operating cylinder device
L, L' extension length

The invention claimed is:

1. An operating cylinder device (100) including at least one multistage telescoping operating hydraulic cylinder unit (50) comprising per telescope stage (50.1, 50.2):

a cylinder (21, 21') including a cylinder base (21*c*) at a rear end and an annular rod seal unit (5) that is attached in a circular opening at an open front end of a cylinder cavity (21*a*), a piston rod (22, 22') that is axially moveable and sealed tight through the annular rod seal unit (5) and which protrudes in outward direction over a portion of its length axially forward out of the cylinder (21, 21) and whose outer circumferential surface (22*a*) is configured as a smooth piston seal surface (22*a*) and contacts the annular rod seal unit (5), a first pressure cavity (1, 1') that is thus formed and sealable tight in an interior of the cylinder (21, 21')

between the annular rod seal unit (5), the piston rod (22, 22') and the cylinder (21, 21') and which includes a first pressure cavity connection (1 *a*, 1'*a*), a mechanical position safety (4) for an axial position of the piston rod (22, 22') relative to the cylinder (21, 21') by cooperating safety elements (4*a, b*), characterized in that at least one piston side safety element (4*a*) is arranged in a rear portion of the piston rod (22, 22'), and at least one cylinder side safety element (4*b*) is arranged in the axial direction (10) in series at or in an inner circumferential surface (21*a*) of the cylinder (21, 21') axially remote from the annular rod seal unit (5), the at least one mechanical position safety (4) is a form locking position safety (4) which is provided by cooperation of the piston side safety elements (4*a*) being interlocking protrusions (4*a*) with the cylinder side safety elements (4*b*) being interlocking recesses (4*b*) in that the interlocking protrusions (4*a*) penetrate the interlocking recesses 4(b), with a precise fit, the interlocking protrusions (4*a*) are arranged at an outer circumference of the piston rod (22) and the interlocking recesses (4*b*) are arranged at an inner circumference of the cylinder (21)

wherein the interlocking recesses (4*b*) are arranged at a uniform distance from each other in the axial direction (10)

and/or plural interlocking recesses (4*b*) are arranged evenly spaced over a circumference at an axial position or an interlocking ring groove (4*b*) extends over the circumference at the axial position.

2. The operating cylinder device (100) according to claim 1, characterized in that the at least one piston side safety element provided as the at least one interlocking protrusion (4*a*) is movable in the radial direction (11) relative to the piston rod (22) between an interlocked position and an unlocked position, displaceable or pivotable and protrudes in the radial direction (11) at least in its interlocked position in an outward direction beyond an outer contour of the piston seal surface (22*a*), and/or the at least one cylinder side interlocking recess (4*b*) is arranged fixed in position at or in an inner circumferential surface (21*a*) of the cylinder (21, 21').

3. The operating cylinder device (100) according to claim 1, characterized in that the at least one piston side interlocking protrusion (4*a*) is arranged in the first pressure cavity (1, 1') and a radial outer surface of the interlocking protrusion (4*a*) that is arranged in the first pressure cavity (1, 1') is greater than a radial inner surface of the interlocking protrusion (4*a*) that is arranged in the first pressure cavity (1, 1'), in that a support protrusion (4*a*3) protrudes radially inward from a radial inner surface of each piston side interlocking protrusion (4*a*) and is supported in a support recess (13) in a radial direction sealed tight so that a freely accessible radial inner face of the support protrusion (4*a*3) is not directly connected with the first pressure cavity (1, 1").

4. The operating cylinder device (100) according to claim 1, characterized in that the piston rod (22) includes a piston end piece (6) at a free end wherein the interlocking protrusions (4*a*) are attached movable in the radial direction (11), radially extensible or pivotable, at a rear end (6*a*) or outer circumference of the piston end piece.

5. The operating cylinder device (100) according to claim 4, characterized in that the interlocking protrusions (4*a*) are configured as interlocking segments (4*a*) that extend over a portion of the circumference, and/or the interlocking protrusions (4*a*) are arranged in a receiving groove (7), of the piston end piece (6) from which they protrude in the radial direction.

6. The operating cylinder device (100) according to claim 5, characterized in that the interlocking segments (4*a*) are secured in a form locking manner in a receiving ring groove (7) in an outer circumference of the piston end piece (6) and secured against a displacement in the circumferential direction (12), in that a support protrusion (4*a*1) protrudes radially inward from a radial back side of each interlocking segment (4*a*) and is radially supported in a support recess (13).

7. The operating cylinder device (100) according to claim 6, characterized in that a supply cavity (14) is provided in the interior of the piston rod (22, 22') of the piston end piece (6), and all support recesses (13) are connected with the supply cavity (14) and form a second pressure cavity (2, 2'), the second pressure cavity (2, 2) is connected with a second pressure cavity connection (2*a*, 2'*a*) in the outer surface of the enveloping cylinder (21, 21') through a connection cavity (15).

8. The operating cylinder device (100) according to claim 7, characterized in that one of at least two supply tubes (31, 32) that are movable axially sealed tight inside each other, thus telescopable, are attached sealed tight at a rear free end of the piston rod (22, 22') protruding backward from the end piece (6) in the axial direction (10) and on the other hand side protruding forward in the axial direction (10) from a cylinder base (21*c*) of a cylinder (21, 21') surrounding the cylinder base, and the connection cavity (15) is enveloped by the supply tubes (31, 32) so that a second pressure cavity (2, 2') is provided by the supply cavity (14) and the connection cavity (15) wherein the second pressure cavity (2, 2') is flow disconnectable from the first pressure cavity (1, 1') and radially enveloped by the first pressure cavity (1, 1').

9. The operating cylinder device (100) according to claim 7, characterized in that in the multistage operating cylinder unit (50)

the first pressure cavities (1, 1') are connected with each other, and/or the second pressure cavities (2, 2') are connected with each other.

10. The operating cylinder device (100) according to claim 7, characterized in that the first pressure cavities (1, 1') and the second pressure cavities (2, 2'), each pressure cavity (1, 1', 2, 2') is connected with a pressure generator, through an adjustable throttle (23, 24) and with a check valve that is adjustable with respect to its closing pressure and/or unlockable, and a control is provided which controls each of the pressure generators and/or each adjustable throttle (23, 24) and each adjustable and/or unlockable check valve.

11. The operating cylinder device (100) according to claim 10, characterized in that at least one pressure sensor is provided which measures a pressure in at least one of the pressure cavities (1, 1', 2, 2') and communicates through signals with the control and/or a differential pressure sensor is provided which measures a pressure difference between the first pressure cavity (1, 1') and the second pressure cavity (2, 2') of each stage of the operating cylinder unit.

12. The operating cylinder device (100) according to claim 11, characterized in that at least one distance sensor is provided which measures an extension length (L, L') of the piston rod (22, 22') relative to the cylinder (21, 21') and the pressure sensor is signal connected with the control, and/or the second pressure cavity (2, 2') is connected through an adjustable pressure relief valve (28) with a tank (27).

13. The operating cylinder device (100) according to claim 12 with at least one operating cylinder unit (50) that includes a mechanical safety for the axial position of the extended connecting rod (22, 22') relative to its cylinder (cylinder (21, 21') of the operating cylinder device (100), characterized in that for extending the piston rod (22, 22') from the cylinder (21, 21')

the first pressure cavity (1, 1') is loaded with a lifting pressure (p1) which loads the piston (22, 22') with an extension force which is greater than a sum of an opposite force impacting the piston (22, 22') and of internal friction forces of the operating cylinder unit (50) until a predetermined nominal extension length is reached, and thus A1: either the second pressure cavity (2, 2') is open towards the tank (27) so that fluid can flow from the tank into the second pressure cavity (2, 2') that expands during expansion so that the fluid can be pulled in, A2: or the second pressure cavity (2, 2') is closed towards the tank (27) but connected with the first pressure cavity (1, 1') during the extension, connected in a highly throttled manner.

14. The operating cylinder device (100) according to claim 13, characterized in that for a controlled retraction of the piston rod (22, 22') that is loaded with an opposite force that is oriented in the retraction direction into the cylinder (21, 21')

initially a function according to one of the steps A1 or A2 is performed, subsequently the interlocking pressure (P3) and the optionally provided interlocking force (F3) are selected in relationship to the lifting pressure (P1) provided in the first pressure cavity (1, 1') so that a resultant force is created that impacts the safety element (4*a*) wherein the resultant is oriented in a radially inward direction, in that a throttle (23) in the pressure cavity connection (1*a*) to the first pressure cavity (1, 1') is set accordingly, wherein this is maintained until the piston rod (22, 22') has reached the completely retracted extension length (L).

15. The operating cylinder device (100) according to claim 14, characterized in that the retraction velocity and/or the pressure in the second pressure cavity (2, 2') is measured and the pressure cavity connection (2*a*, 2'*a*) of the second pressure cavity (2, 2') is closed partially or entirely when a predetermine threshold value is exceeded.

16. The operating cylinder device (100) according to claim 12, including plural operating cylinder units (50), characterized in that the control controls all operating cylinder units (50), or all pressure generators, or all adjustable valves, all adjustable throttles (23, 24), all adjustable and/or unlockable check valves and all adjustable pressure relief valves (28), and either all first pressure cavities (1, 1') of all operating cylinder units (50) are connected in an interrupt able manner with a first distribution cavity (51) which is connected with a first pressure generator and all second pressure cavities (2, 2') of all operating cylinder units (50) are connected in an interruptible manner with a second distribution cavity (52) that is connected with a second pressure generator, or all pressure cavities (1, 1', 2, 2') of all operating cylinder units (50) are connected in an interruptible manner with a first distribution cavity (51) that is connected with a pressure generator.

17. The operating cylinder device (100) according to claim 10, characterized in that a mechanical safety for the axial position of the extended piston rod (22, 22') is provided in that a pressure in the first pressure cavity is reduced from the lifting pressure (p1) to a lowering pressure (p2) which loads the piston rod (22, 22') with a force which is smaller than a sum of an opposite force impacting the piston (22, 22') and of internal friction forces of the operating cylinder unit (50) until the piston (22, 22') is axially retracted far enough so that the safety elements (4*a*, *b*) that cooperate through form locking can interlock with each other, the at least one interlocking protrusions (4*a*) can interlock in one of the interlocking protrusions (4*b*) and the interlocking is caused, and/or a hydraulic safety of the axial position of the extended piston rod (22, 22') is provided in that reaching the predetermined nominal extension length the unlockable check valves of each of the two pressure cavities (1, 1') and (2, 2') are closed by turning the pressure supply off so that the two pressure cavities with the operating medium enclosed therein are closed.

18. The operating cylinder device (100) according to claim 17, characterized in that for securing an interlocking of the safety element (4*a*) of the interlocking protrusion (4*a*) of the interlocking segment (4*a*) is caused during interlocking in that a radial outside as well as a portion of the radial inside of the radially movable safety element (4*a*), the first pressure cavity (1, 1') is loaded with the lowering pressure (P2), and a remaining portion of the radial inside of the safety element (4*a*), the second pressure cavity (2, 2') is loaded with an interlocking pressure (p3) and optionally with an additional mechanically induced interlocking force (F3), wherein the the interlocking pressure (p3) and the optionally provided interlocking force (F3) are selected relative to the lower pressure (p2) so that a resulting force is provided that impacts the safety element (4*a*) in a radial direction wherein the resulting force is oriented in a radially outward direction when the interlocking force (F3) is provided the interlocking pressure (p3) is selected higher than the lowering pressure (p2).

19. A lifting device (60) with an operating cylinder unit (50) of an operating cylinder device (100), according to claim 1, characterized in that the operating cylinder unit (50) with a piston rod (22) that is extendable in an upward direction from a cylinder (21) is arranged in a base frame (61) of the lifting device (60), wherein support legs (62*a, b, c*,) extend in a radially outward and downward direction from the lifting device (60) wherein the support legs are braced with their respective radially outward support end by a horizontal strut (63*a, b, c*) relative to the cylinder (21) and sit on the ground, a display device (40) is arranged at each lifting device (60).

20. The lifting device (60) according to claim 19, characterized in that a sensor piston (42*b*) is arranged in an elevation range below an attachment of one of the support legs (62) at the cylinder (21) on an outside of the cylinder (21), in top view below one of the support legs (62), between the support leg (62) and its horizontal strut (63).

21. The lifting device (60) according to claim 19, characterized in that an LED of the display device is arranged between 1 m and 2 m elevation at an outside of the cylinder (21) at plural circumferential locations.

22. The lifting device (60) according to claim 19, characterized in that the display device (40) is received in a recess of a valve block (46) of the operating cylinder unit (50), the valve block (46) is bolted directly at an outside of the cylinder (21) of the operating cylinder unit (50) and the valve block (46) extends on a side of the display device (40) which is on an outside with reference to a longitudinal center (10') of the operating cylinder unit (50).

23. The lifting device (60), according to claim 19, characterized in that a respective hydraulic safety element is arranged in the cylinder (21) of the operating cylinder unit (50) in connection conduits between the pressure cavities (1, 2) and the valve block (46), the display device (40) is flow connected with portions of the connection conduits between the pressure cavities (1, 2) and the valve block (46).

24. An operating cylinder device (100) including at least one multistage telescoping operating hydraulic cylinder unit (50) comprising per telescope stage (50.1, 50.2):

a cylinder (21, 21') including a cylinder base (21*c*) at a rear end and an annular rod seal unit (5) that is attached in a circular opening at an open front end of a cylinder cavity (21*a*), a piston rod (22, 22') that is axially moveable and sealed tight through the annular rod seal unit (5) and which protrudes in outward direction over a portion of its length axially forward out of the cylinder (21, 21) and whose outer circumferential surface (22*a*) is configured as a smooth piston seal surface (22*a*) and contacts the annular rod seal unit (5), a first pressure cavity (1, 1') that is thus formed and sealable tight in an interior of the cylinder (21, 21') between the annular rod seal unit (5), the piston rod (22, 22') and the cylinder (21, 21') and which includes a first pressure cavity connection (1*a*, 1'*a*), a mechanical position safety (4) for an axial position of the piston rod (22, 22') relative to the cylinder (21, 21') by cooperating safety elements (4*a, b*), characterized in that at least one piston side safety element (4*a*) is arranged in a rear portion of the piston rod (22, 22'), at least one cylinder side safety element (4*b*) is arranged in the axial direction (10) in series at or in an inner circumferential surface (21*a*) of the cylinder (21, 21') axially remote from the annular rod seal unit (5), the at least one mechanical position safety (4) is a form locking position safety (4) which is provided by cooperation of the piston side safety elements (4*a*) being interlocking protrusions (4*a*) with the cylinder side safety elements (4*b*) being interlocking recesses (4*b*) in that the interlocking protrusions (4*a*) penetrate the interlocking recesses (4*b*), with a precise fit, the interlocking protrusions (4*a*) are arranged at an outer circumference of the piston rod (22) and the interlocking recesses (4*b*) are arranged at an inner circumference of the cylinder (21), the piston rod (22) includes a piston end piece (6) at a free end wherein the interlocking protrusions (4*a*) are attached movable in the radial direction (11), radially extensible or pivotable, at a rear end (6*a*) or outer circumference of the piston end piece, the interlocking protrusions (4*a*) are configured as interlocking segments (4*a*) that extend over a portion of the circumference, the interlocking segments (4*a*) are secured in a form locking manner in a receiving ring groove (7) in an outer circumference of the piston end piece (6) and secured against a displacement in the circumferential direction (12), and in that a support protrusion (4*a*1) protrudes radially inward from a radial back side of each interlocking segment (4*a*) and is radially supported in a support recess (13).

25. A lifting device (60) with an operating cylinder unit (50) of an operating cylinder device (100) including at least one multistage telescoping operating hydraulic cylinder unit (50) comprising per telescope stage (50.1, 50.2):

a cylinder (21, 21') including a cylinder base (21*c*) at a rear end and an annular rod seal unit (5) that is attached in a circular opening at an open front end of a cylinder cavity (21*a*), a piston rod (22, 22') that is axially moveable and sealed tight through the annular rod seal unit (5) and which protrudes in outward direction over a portion of its length axially forward out of the cylinder (21, 21) and whose outer circumferential surface (22*a*) is configured as a smooth piston seal surface (22*a*) and contacts the annular rod seal unit (5), a first pressure cavity (1, 1') that is thus formed and sealable tight in an interior of the cylinder (21, 21') between the annular rod seal unit (5), the piston rod (22, 22') and the cylinder (21, 21') and which includes a first pressure cavity connection (1*a*, 1'*a*), a mechanical position safety (4) for an axial position of the piston rod (22, 22') relative to the cylinder (21, 21') by cooperating safety elements (4*a, b*), wherein at least one piston side safety element (4*a*) is arranged in a rear portion of the piston rod (22, 22'), and at least one cylinder side safety element (4*b*) is arranged in the axial direction (10) in series at or in an inner circumferential surface (21*a*) of the cylinder (21, 21') axially remote from the annular rod seal unit (5), wherein the lifting device (60) is characterized in that the operating cylinder unit (50) with a piston rod (22) that is extendable in an upward direction from a cylinder (21) is arranged in a base frame (61) of the lifting device (60), wherein support legs (62 *a, b, c*,) extend in a radially outward and downward direction from the lifting device (60) wherein the support legs are braced with their respective radially outward support end by a horizontal strut (63*a, b, c*) relative to the cylinder (21) and sit on the ground, a display device (40) is arranged at each lifting device (60).

* * * * *